US011840070B2

(12) United States Patent
Kato

(10) Patent No.: US 11,840,070 B2
(45) Date of Patent: Dec. 12, 2023

(54) ATTACHMENT AND PRINTING APPARATUS

(71) Applicant: BROTHER KOGYO KABUSHIKI KAISHA, Nagoya (JP)

(72) Inventor: Yushi Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 226 days.

(21) Appl. No.: 17/000,261

(22) Filed: Aug. 21, 2020

(65) Prior Publication Data

US 2021/0060985 A1 Mar. 4, 2021

(30) Foreign Application Priority Data

Aug. 26, 2019 (JP) ..... 2019-153341

(51) Int. Cl.
*B41J 15/04* (2006.01)
*B41J 15/02* (2006.01)

(52) U.S. Cl.
CPC ..... *B41J 15/042* (2013.01); *B41J 15/02* (2013.01); *B41J 15/044* (2013.01)

(58) Field of Classification Search
CPC ..... B41J 15/042; B41J 15/02; B41J 15/044; B41J 15/046; B41J 3/4075; B41J 13/00; B65H 2403/411; B65H 2801/12; B65H 16/005; B65H 16/06; B65H 19/12
See application file for complete search history.

(56) References Cited

U.S. PATENT DOCUMENTS

2015/0109396 A1 4/2015 Kawamoto
2019/0160836 A1 5/2019 Tsuchida

FOREIGN PATENT DOCUMENTS

JP 60-204559 A 10/1985
JP 6-219002 A 8/1994
JP 2015-9439 A 1/2015
JP 2018-187942 A 11/2018
JP 2019-93648 A 6/2019

OTHER PUBLICATIONS

Japanese Office Action issued in corresponding Japanese patent application No. 2019-153341 dated May 30, 2023.

*Primary Examiner* — Kristal Feggins
(74) *Attorney, Agent, or Firm* — KENEALY VAIDYA LLP

(57) ABSTRACT

An attachment capable of being attached, in a detachable manner, to an accommodation part of a printing apparatus which is for accommodating a print medium, the attachment being configured to support a roll including the print medium which is wound, the attachment including: a housing having a substantially box shape of which an upper part is opened, the housing being configured to accommodate the roll inside thereof in a replaceable manner; an engaging part provided to the housing and configured to engage, in a disengageable manner, to an engaged part provided to the accommodation part when the housing is attached to the accommodation part; and a support part provided to the housing and configured to rotatably support the roll.

2 Claims, 21 Drawing Sheets

ATTACHMENT AND PRINTING APPARATUS

CROSS-REFERENCE TO RELATED APPLICATIONS

This application is based upon and claims the benefit of priority from prior Japanese patent application No. 2019-153341, filed on Aug. 26, 2019, the entire contents of which are incorporated herein by reference.

TECHNICAL FIELD

The present disclosure relates to an attachment and a printing apparatus.

BACKGROUND ART

In related art, known is a printing apparatus having a pair of guide members configured to support roll paper. Each of the pair of guide members has a support part that is inserted into a shaft center hole of the roll paper and protrudes in an annular shape.

However, a size of an inner diameter of the shaft center hole is different, depending on a type of the roll paper, so that the roll paper cannot be supported in some cases. If a diameter of the support part is reduced, the roll paper may move eccentrically to cause poor conveyance. Therefore, the diameter of the support part cannot be simply reduced.

SUMMARY

The present disclosure provides an attachment by which a desired roll can be mounted to a printing apparatus even when the desired roll cannot be directly mounted to the printing apparatus, and a printing apparatus including the attachment.

According to an aspect of the present disclosure, there is provided an attachment capable of being attached, in a detachable manner, to an accommodation part of a printing apparatus which is for accommodating a print medium, the attachment being configured to support a roll including the print medium which is wound, the attachment including: a housing having a substantially box shape of which an upper part is opened, the housing being configured to accommodate the roll inside thereof in a replaceable manner; an engaging part provided to the housing and configured to engage, in a disengageable manner, to an engaged part provided to the accommodation part when the housing is attached to the accommodation part; and a support part provided to the housing and configured to rotatably support the roll.

According to another aspect of the present disclosure, there is provided a printing apparatus including: an accommodation part which is for accommodating a print medium; and an attachment capable of being attached, in a detachable manner, to the accommodation part, the attachment being configured to support a roll including the print medium which is wound, wherein the attachment includes: a housing having a substantially box shape of which an upper part is opened, the housing being configured to accommodate the roll inside thereof in a replaceable manner; an engaging part provided to the housing and configured to engage, in a disengageable manner, to an engaged part provided to the accommodation part when the housing is attached to the accommodation part; and a support part provided to the housing and configured to rotatably support the roll.

DESCRIPTION OF EMBODIMENTS

Figure 1:
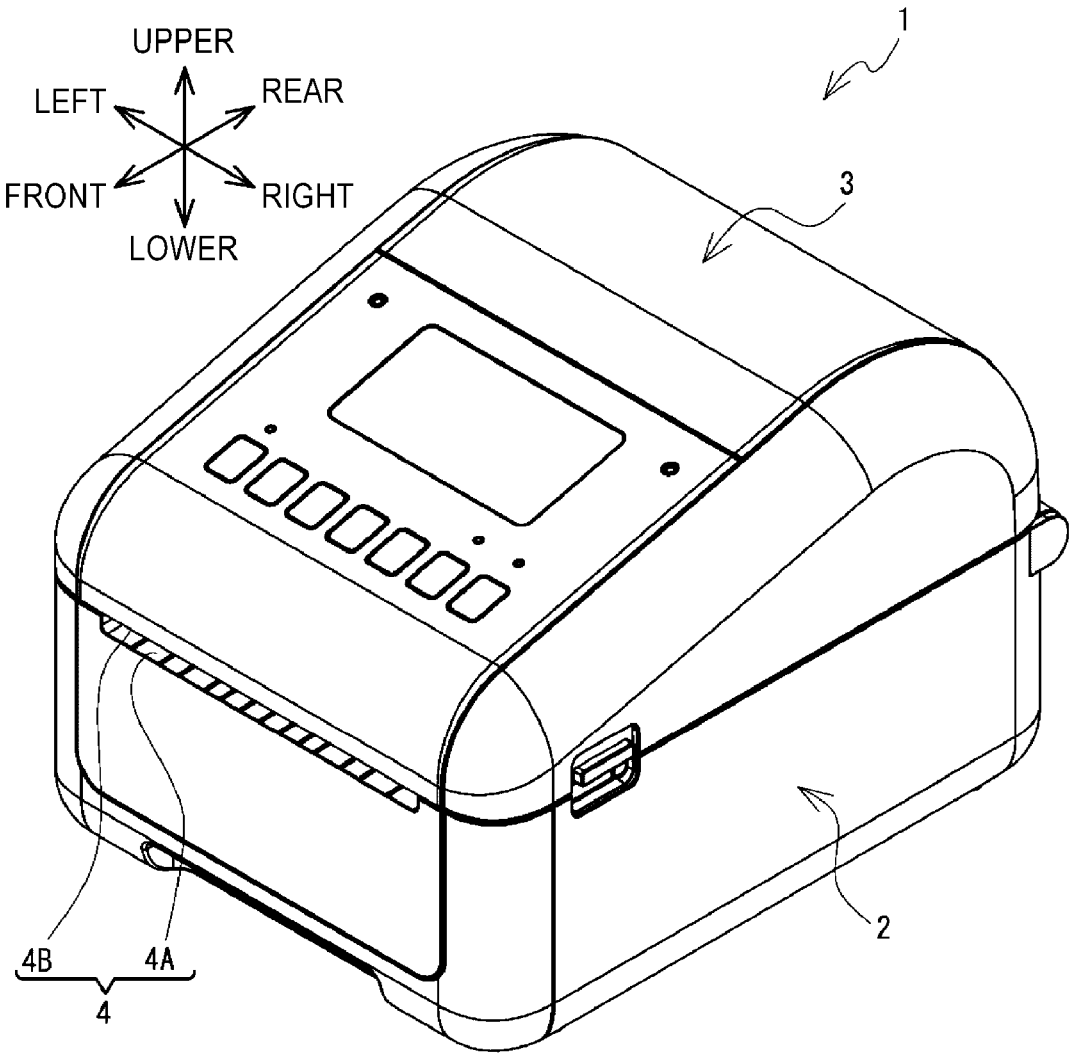
FIG. 1 is a perspective view of a printing apparatus 1.

A first embodiment of the present disclosure will be described with reference to FIGS. 1 to 15. In descriptions below, the left and right, the front and rear and the upper and lower indicated using arrows in the drawings are used.

Figure 2:
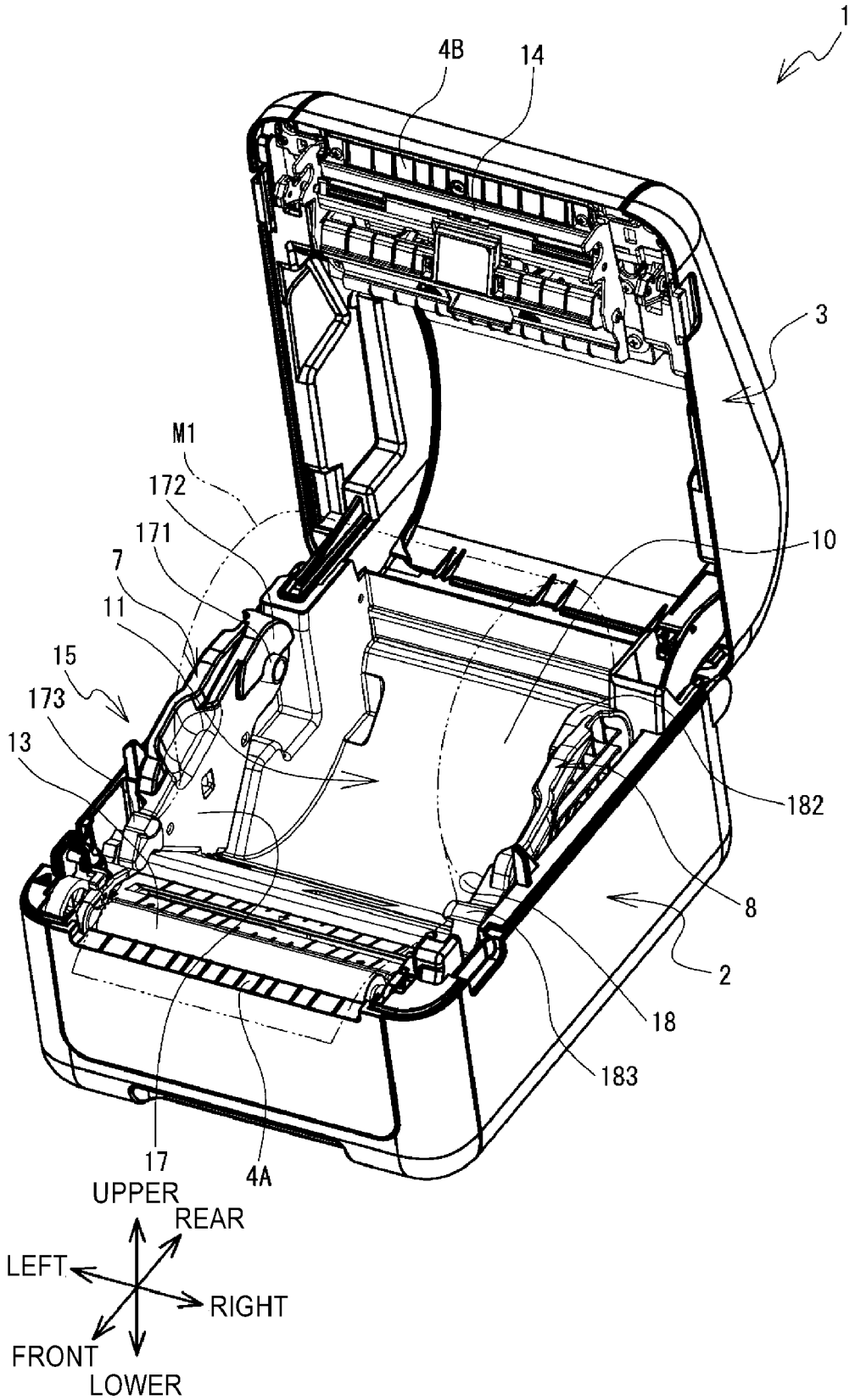
FIG. 2 is a perspective view of the printing apparatus 1 of which a cover 3 is opened.

A configuration of a printing apparatus 1 is described with reference to FIGS. 1 to 3. The printing apparatus 1 shown in FIGS. 1 to 3 can print, on a print medium, print data stored in a memory or print data received from an external device (not shown) such as a PC terminal, for example. The print medium is, for example, a heat sensitive label. As shown in FIGS. 1 and 2, the printing apparatus 1 includes a main body part 2, a cover 3, and a discharging part 4. The main body part 2 and the cover 3 are formed of, for example, a resin material. The discharging part 4 is provided on a front surface of the printing apparatus 1, and is configured to discharge a tape (which will be described later) printed inside of the printing apparatus 1 to an outside of the printing apparatus. The discharging part 4 is a slit that is long in a right and left direction. The discharging part 4 is configured by a lower side forming part 4A (which will be described later) provided on a front part of the main body part 2 and an upper side forming part 4B (which will be described later) provided on a front part of the cover 3.

The main body part 2 has a substantially cuboid box shape. As shown in FIG. 2, the main body part 2 configures a lower part of the printing apparatus 1, and has a main body cover 10, an accommodation part 11, a platen roller 13, and a roll holding mechanism 15. The main body cover 10 is a plate-shaped member provided at an upper part of the main body part 2 and curved downwardly in an arc shape at a center, as seen from a side. The accommodation part 11 is an internal space of the printing apparatus 1 demarcated by the main body cover 10. In the accommodation part 11, a roll M1 is accommodated in a state where a shaft center hole faces in the right and left direction. The roll M1 is configured by bonding the heat sensitive label to a mount (release paper) with an adhesive and winding the label around a cylindrical core. The heat sensitive label having a mount is hereinbelow referred to as "tape". The roll holding mechanism 15 is provided to the accommodation part 11 and is configured to detachably support the roll M1. The platen roller 13 is provided in front of the accommodation part 11 at the upper part of the main body part 2. The platen roller 13 is a circular column-shaped roller for conveying the tape in a front and rear direction, and is provided along a longitudinal direction (right and left direction) of the discharging part 4. The lower side forming part 4A having a concave shape as seen from front is provided in front of the platen roller 13. The lower side forming part 4A forms a lower side part of the discharging part 4.

The cover 3 is pivotally supported so as to be openable/closable about a shaft extending in the right and left direction at the rear upper part of the main body part 2. A thermal head 14 extends in the right and left direction on a lower surface of the front part of the cover 3. The thermal head 14 has a plurality of heat generating elements aligned in the right and left direction. The thermal head 14 is controlled by an electronic circuit board (not shown), and can print a character and the like on the heat sensitive label by heating. The upper side forming part 4B is provided in front of the thermal head 14. The upper side forming part 4B forms an upper side part of the discharging part 4.

A structure of the roll holding mechanism 15 is described with reference to FIG. 3. The roll holding mechanism 15 includes a left holding part 7, a right holding part 8, and a support stand 20, and has a substantial U-shape opening upward, as seen from front.

The left holding part 7 is a plate-shaped member having a substantially right-angled triangular shape, as seen from a side. The left holding part 7 has a facing surface 17, a protrusion 171, a fan-shaped portion 172, a guide portion 173, a first engaged hole 174, a second engaged hole 175, a coupling part 7A and the like. The facing surface 17 is a surface facing the right holding part 8. The protrusion 171 has a truncated conical shape protruding from an upper part of the facing surface 17 toward the right holding part 8. The fan-shaped portion 172 extends in a circumferential direction over an area corresponding to a substantial half of an upper side around the protrusion 171, and protrudes from the facing surface 17 toward the right holding part 8. A protruding amount of the fan-shaped portion 172 is smaller than a protruding amount of the protrusion 171.

The guide portion 173 protrudes from a front part of the left holding part 7 toward the right holding part 8. The first engaged hole 174 is provided on a front side of the facing surface 17 at the rear of the guide portion 173. The first engaged hole 174 is a circular hole penetrating in the right and left direction. The second engaged hole 175 is an oval hole provided on a rear side of the facing surface 17 and penetrating in the right and left direction, and a long diameter thereof extends toward a center of the first engaged hole 174. The coupling part 7A has a rectangular plate shape extending from a rear side of a lower end portion of the left holding part 7 toward the right holding part 8. The coupling part 7A is fixed to a guide member 22 of the support stand 20 (which will be described later) by screws via guide grooves (not shown) provided in the main body cover 10.

The right holding part 8 is substantially bilaterally symmetrical to the left holding part 7. Although not described in detail, like the left holding part 7, the right holding part 8 also has a facing surface 18, a protrusion (not shown), a fan-shaped portion 182, a guide portion 183, a first engaged hole (not shown), a second engaged hole (not shown), a coupling part 8A and the like. The coupling part 8A is fixed to a guide member 23 of the support stand 20 (which will be described later) by screws via guide grooves (not shown) provided in the main body cover 10.

The support stand 20 has a base 21, a guide member 22, a guide member 23, a pinion gear 24, a coil spring 28, a coil spring 29, a positioning tool 26, a nut 27 and the like. The base 21 has a main body part 201 and a front side support part 202. The main body part 201 has a substantially rectangular plate shape that is long in the right and left direction, as seen from above. The front side support part 202 protrudes forward from a left portion of a front end portion of the main body part 201, and has a substantially rectangular plate shape that is long in the right and left direction, as seen from above. On an upper surface of the main body part 201, the guide member 22, the guide member 23, the pinion gear 24, the coil springs 28 and 29 and the like are arranged.

The guide member 22 has a substantially rectangular plate shape that is elongated in the right and left direction, as seen from above, and is supported to be movable in the right and left direction on an upper rear side of the main body part 201. A front end portion of the guide member 22 is provided with a rack gear (not shown). The guide member 23 has a substantially rectangular plate shape that is elongated in the right and left direction, as seen from above, and is supported to be movable in the right and left direction on an upper front side of the main body part 201, like the guide member 22. A rear end portion of the guide member 23 is provided with a rack gear (not shown). A front end portion of the guide member 23 is provided with a locking portion 231 protruding forward.

A shaft of the pinion gear 24 is supported to be rotatable at a substantial center of an upper surface of the main body part 201 and between the front end portion of the guide member 22 and the rear end portion of the guide member 23. The pinion gear 24 is in mesh with the rack gear provided at the front end portion of the guide member 22 and the rack gear provided at the rear end portion of the guide member 23. Thereby, when the guide member 23 is moved rightward, the pinion gear 24 is rotated in a counterclockwise direction, as seen from above, so that the guide member 22 is moved leftward. As a result, the left holding part 7 and the right holding part 8 are moved away from each other. On the other hand, when the guide member 23 is moved leftward, the pinion gear 24 is rotated in a clockwise direction, as seen from above, so that the guide member 22 is moved rightward. As a result, the left holding part 7 and the right holding part 8 are moved toward each other.

The coil spring 28 is provided between a right end portion of the main body part 201 and a left end portion of the guide member 22, and biases rightward the guide member 22 all the time. The coil spring 29 is provided between a left end portion of the main body part 201 and a right end portion of the guide member 23, and biases leftward the guide member 23 all the time. Thereby, the left holding part 7 and the right holding part 8 are always biased toward each other by the coil springs 28 and 29.

The positioning tool 26 is arranged on an upper surface of the front side support part 202. The positioning tool 26 has a screw portion 261 and an operation portion 262. The screw portion 261 has a rod shape extending in the right and left direction, and is rotatably supported on the upper surface of the front side support part 202. The operation portion 262 is provided perpendicularly to a left end portion of the screw portion 261 and has a substantially disk shape. A rotation operation of the operation portion 262 rotates the screw portion 261.

The nut 27 is in mesh with the screw portion 261 of the positioning tool 26 on the upper surface of the front side support part 202. As the operation portion 262 is rotated in forward and reverse directions, the nut 27 is moved in the right and left direction.

As described above, since the guide member 23 is always biased leftward by the coil spring 29, the locking portion 231 is locked to the nut 27 from the right. Since a position of the guide member 23 is determined in a position of the nut 27, a position of the right holding part 8 is determined. When the position of the right holding part 8 is determined, a position of the guide member 22 is relatively determined via the pinion gear 24, so that a position of the left holding part 7 is also determined. A user can adjust appropriately a spaced width between the left holding part 7 and the right holding part 8 by a rotating operation on the operation portion 262 of the positioning tool 26.

A method of operating the roll holding mechanism 15 is described. As shown in FIG. 2, the user opens the cover 3 to expose the accommodation part 11. In the accommodation part 11, the user manually pushes and opens the left holding part 7 and the right holding part 8 away from each other (toward outer sides in the right and left direction) against the biasing force of the coil springs 28 and 29. The user arranges, between the left holding part 7 and the right holding part 8, the roll M1 in a state where it is wound in the counterclockwise direction, as seen from a right side surface. When the user releases the operation on the left holding part 7 and the right holding part 8, the left holding part 7 and the right holding part 8 move to positions, in which the fan-shaped portions 172 and 182 come into contact with left and right end faces of the roll M1, by the biasing force of the coil springs 28 and 29. When the fan-shaped portions 172 and 182 come into contact with both the end faces of the roll M1, the movement of the left holding part 7 and the right holding part 8 is stopped. The protrusion 171 of the left holding part 7 and the protrusion of the right holding part 8 are fitted in the shaft center hole of the roll M1. As a result, a spaced distance between the fan-shaped portions 172 and 182 is substantially the same as a width of the roll M1. The user causes the tape pulled out from the roll M1 to pass below the guide portion 173 of the left holding part 7 and the guide portion 183 of the right holding part 8, and arranges the same in the vicinity of the discharging part 4. The user closes the cover 3.

A printing operation of the printing apparatus 1 is described. In a state where the roll M1 is accommodated in the accommodation part 11 and the cover 3 is closed, the thermal head 14 and the platen roller 13 are close to each other. The tape is arranged between the thermal head 14 and the platen roller 13. The thermal head 14 presses the tape toward the platen roller 13. The platen roller 13 is rotated by drive of a conveyor motor (not shown), thereby pulling out the tape from the roll M1 and conveying the tape pressed by the thermal head 14. The heat generating elements of the thermal head 14 selectively generate heat, so that the thermal head 14 prints a character and the like on the heat sensitive label bonded to the tape in a line unit. In a state where the cover 3 is closed, the discharging part 4 discharges the tape to which the heat sensitive label printed inside of the printing apparatus 1 is bonded to an outside of the printing apparatus 1. In the meantime, the printing apparatus 1 may include a cutting part provided to the discharging part 4 and configured to cut the printed tape in a predetermined position, for example. As the cutting part, a cutting member having saw-shaped teeth aligned in the right and left direction, a cutter mechanism having a cutting blade or the like may be adopted, for example.

A case where the roll cannot be supported by the roll holding mechanism 15 due to a size of the shaft center hole of the roll is described. For example, when an inner diameter of the shaft center hole of the roll is different from each of inner diameters of the protrusion 171 of the left holding part 7 and the protrusion of the right holding part 8, the problem of the poor conveyance may be caused, like the related art. As a result, the roll cannot be directly mounted to the roll holding mechanism 15. In the present embodiment, the user can mount the roll to the roll holding mechanism 15 by using an attachment 100 (refer to FIG. 4). In the meantime, a configuration and an operational effect of the attachment 100 will be described later.

Figure 4:
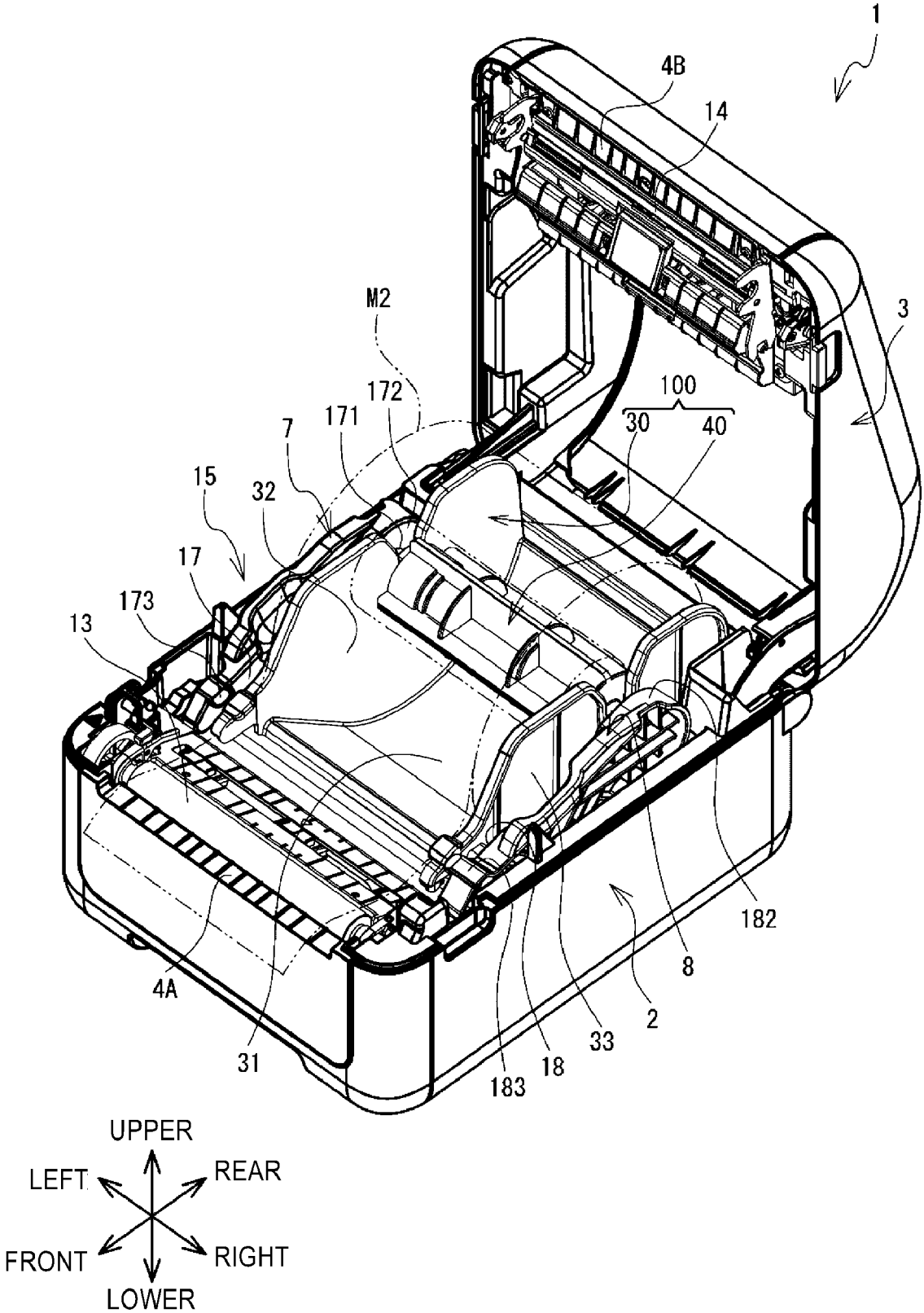
FIG. 4 is a perspective view of the printing apparatus 1 to which an attachment 100 is attached.

A case where a roll including a linerless tape is used as the roll that cannot be directly mounted to the roll holding mechanism 15 is described. The linerless tape is a tape with no mount (release paper), unlike the above-described tape. A roll M2 shown in FIG. 4 is configured by winding a linerless tape around a tubular core in a state where a surface having an adhesive (hereinbelow, referred to as 'adhesive surface') is arranged as an inner side. A case is assumed in which the roll M2 is sandwiched between the left holding part 7 and the right holding part 8 of the roll holding mechanism 15, like the roll M1, and a printing is performed by the printing apparatus 1. The linerless tape that is pulled out and conveyed from the roll M2 has an upper side that is a print surface and a lower side that is an adhesive surface. After executing the printing operation, the printing apparatus 1 reverses the platen roller to convey the tape in a reverse direction before a next printing operation, so as to reduce a leading margin corresponding to a distance between the thermal head 14 and the cutting part. At this time, the tape is loosened as the tape is conveyed in the reverse direction. However, a particular problem is not caused for the tape with a mount even if the loosening occurs. On the other hand, in the case of the linerless tape, when the loosening occurs during the conveying in the reverse direction, the adhesive surface on the lower side of the linerless tape adheres to a conveying path, so that a printing defect may be generated. Therefore, in the present embodiment, the user mounts the roll M2 to the roll holding mechanism 15 by using the attachment 100, so that it is possible to prevent the loosening when conveying the linerless tape in the reverse direction.

Figure 5:
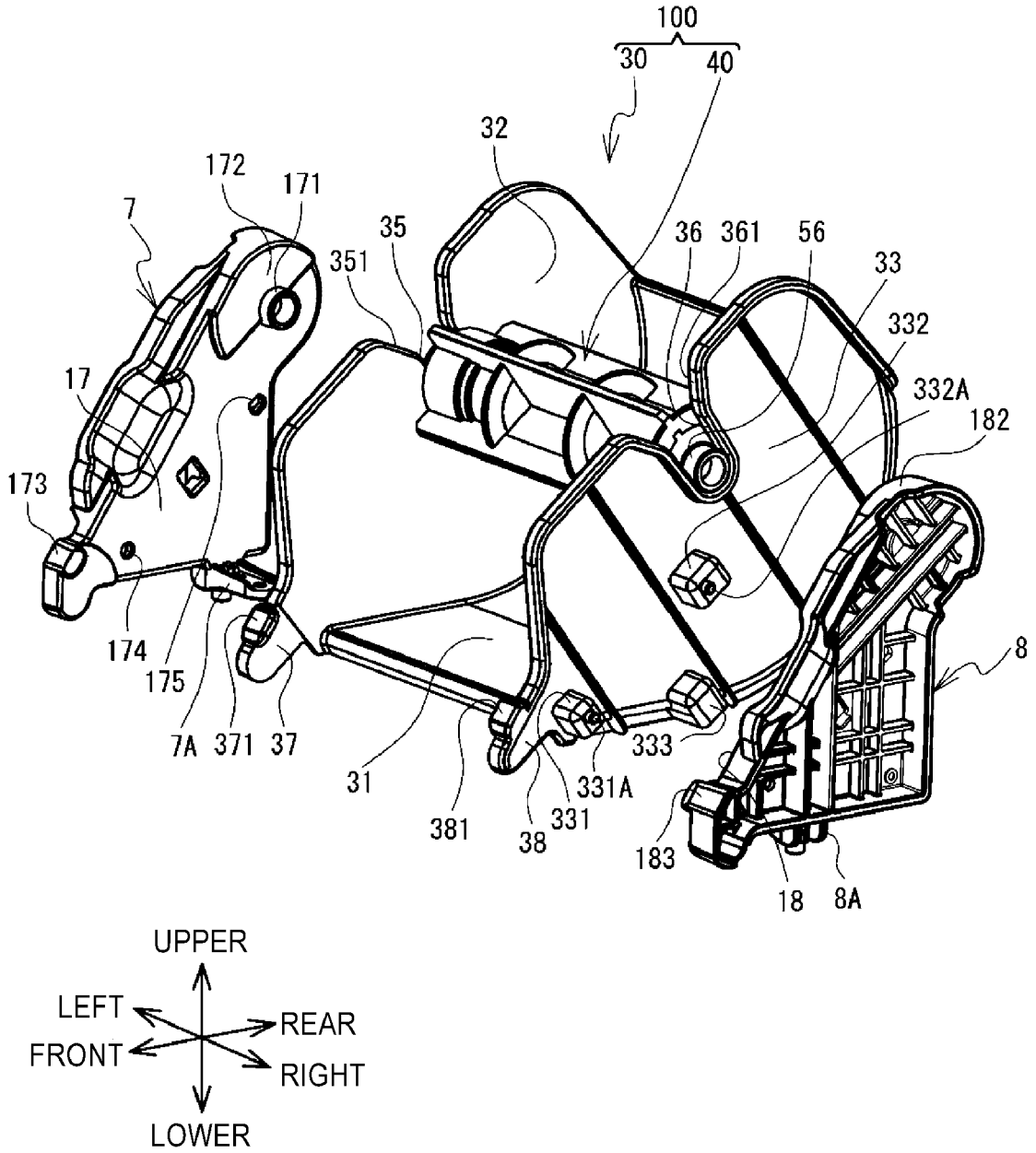
FIG. 5 is a perspective view of a left holding part 7, a right holding part 8 and the attachment 100.

A configuration of the attachment 100 is described with reference to FIGS. 4 and 5. The attachment 100 includes a housing 30 and a roll holding member 40. The housing 30 is configured to accommodate the roll M2 in a replaceable manner and is detachably attached to the roll holding mechanism 15 of the printing apparatus 1. The roll holding member 40 is internally fitted to the shaft center hole of the roll M2 and is attached to the housing 30, thereby rotatably supporting the roll M2.

Figure 6:
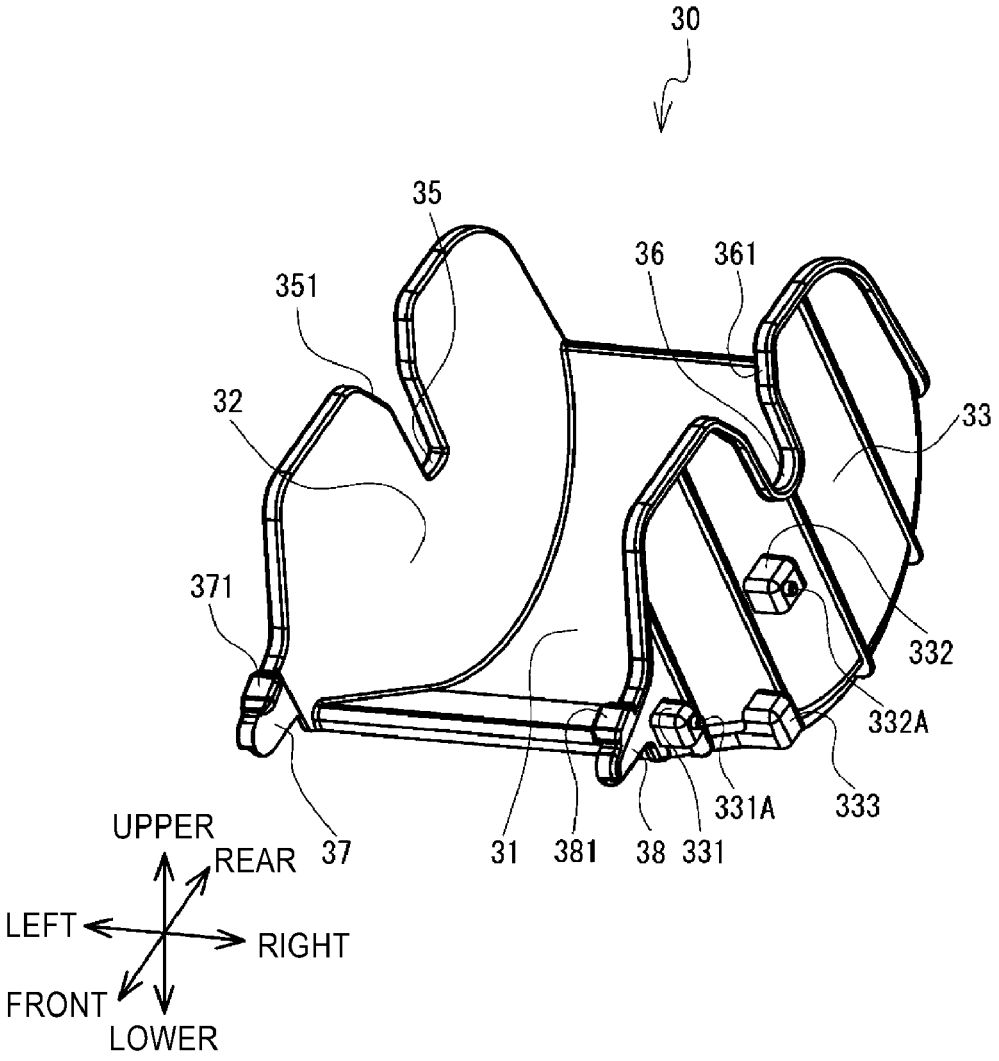
FIG. 6 is a perspective view of a housing 30, as seen diagonally from the right front.
Figure 7:
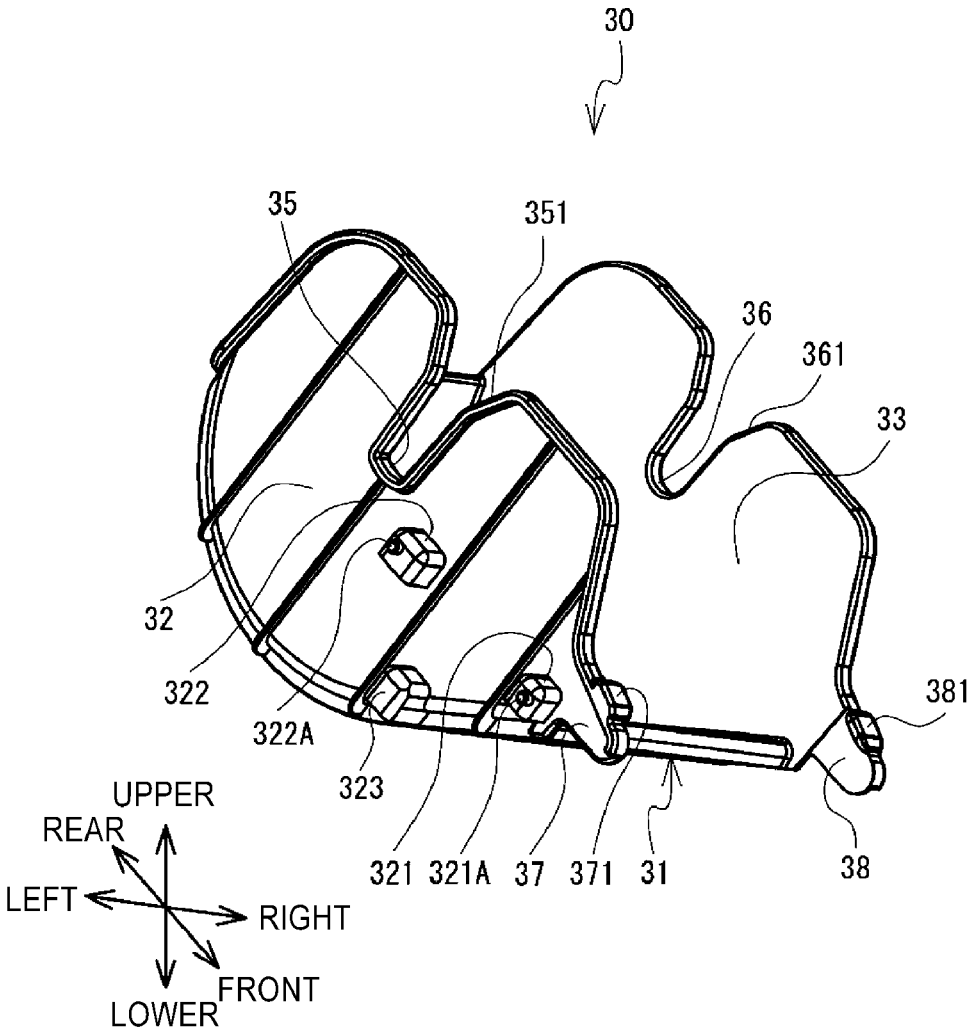
FIG. 7 is a perspective view of the housing 30, as seen diagonally from the left front.
Figure 8:
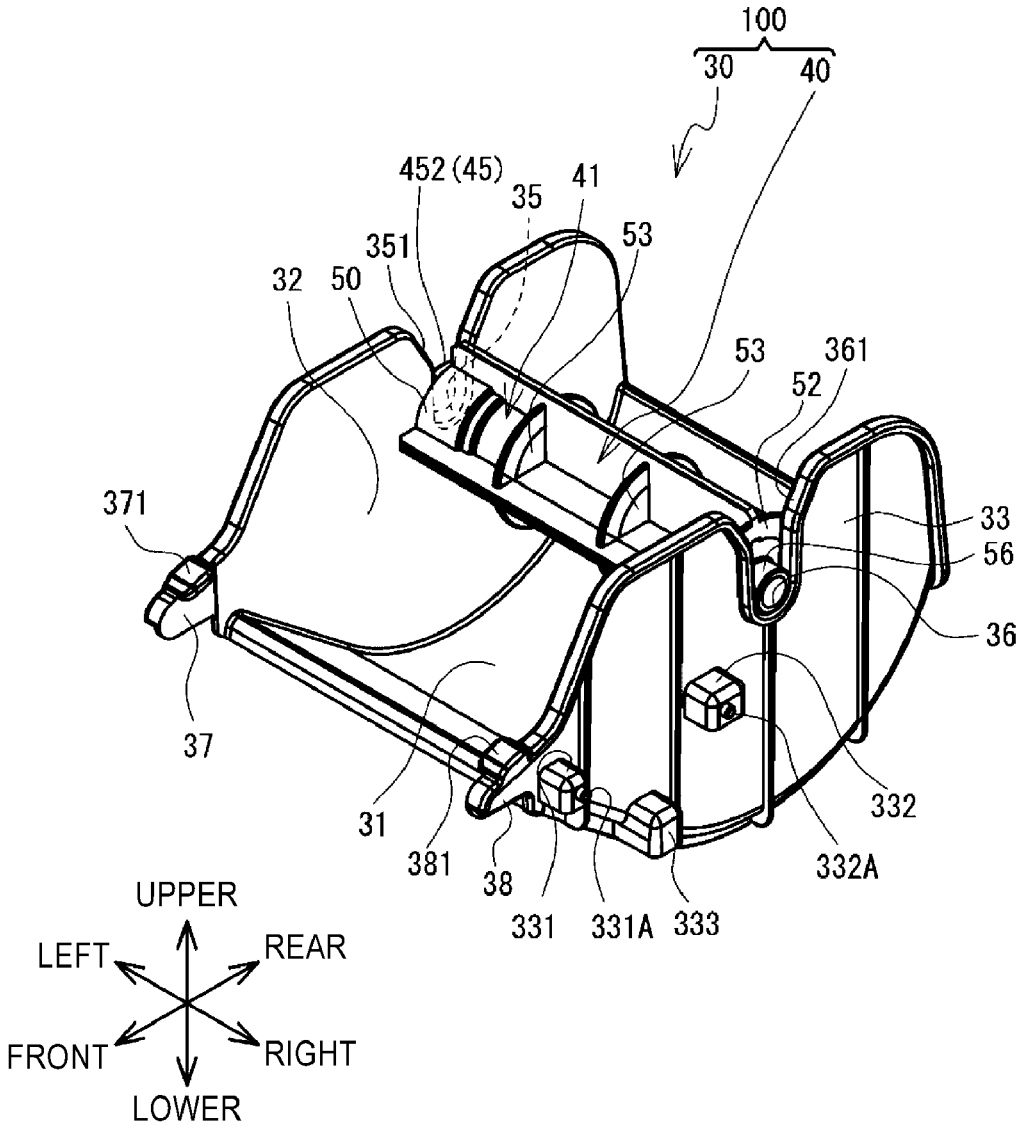
FIG. 8 is a perspective view of the attachment 100.

A structure of the housing 30 is described with reference to FIGS. 6 and 7. In the meantime, the housing 30 shown in FIGS. 5 to 7 is shown with a posture at which it is attached to the roll holding mechanism 15. The housing 30 has a substantially box shape of which an upper part is opened, and can accommodate therein rolls of diverse sizes. The housing 30 has a bottom wall part 31, a left wall part 32, and a right wall part 33. The bottom wall part 31 has a substantially rectangular shape that is long in the front and rear direction, as seen from above, and a central portion thereof is curved downwardly in a substantially arc shape, as seen from a side.

As shown in FIG. 7, the left wall part 32 is erected upward from a left end portion of the bottom wall part 31, and has a substantially heart shape, as seen from a left side. A lower end portion of the left wall part 32 is curved in an arc shape. An upper end portion of the left wall part 32 has a substantially linear shape extending in the front and rear direction except a central portion in the front and rear direction. The left wall part 32 has a forward protruding part 37, a guide portion 371, a locked groove 35, tapered portions 351, a first protrusion portion 321, a second protrusion portion 322, a third protrusion portion 323 and the like. The forward protruding part 37 protrudes forward from a front end portion of the left wall part 32, and has an elongated plate shape as seen from a left side. The guide portion 371 protrudes rightward from an upper end portion of the forward protruding part 37. The locked groove 35 has a rectangular shape that extends downwardly from a central portion in the front and rear direction of the upper end portion of the left wall part 32 and is vertically long, as seen from a side. A lower end portion of the locked groove 35 is located at a substantially central portion of the left wall part 32 in the upper and lower direction. The tapered portions 351 are formed at both front and rear portions of an upper part of the locked groove 35, and each expand in a tapered shape from below to upper.

The first protrusion portion 321, the second protrusion portion 322, and the third protrusion portion 323 are provided on a left side surface (outer surface) of the left wall part 32. The first protrusion portion 321 is provided at a lower portion of a front end portion of the left side surface of the left wall part 32 and behind the forward protruding part 37. The first protrusion portion 321 protrudes leftward in a substantially cuboid shape. A tip end face of the first protrusion portion 321 is provided with a pin 321A further protruding leftward. The second protrusion portion 322 is provided at a substantially central portion of the left side surface of the left wall part 32 and in front of a lower part of the locked groove 35. The second protrusion portion 322 also protrudes leftward in a substantially cuboid shape. A tip end face of the second protrusion portion 322 is also provided with a pin 322A further protruding leftward. The third protrusion portion 323 is provided at a lower part of the front end portion of the left side surface of the left wall part 32 with being spaced rearward from the first protrusion portion 321. The third protrusion portion 323 also protrudes leftward in a substantially cuboid shape. Protruding amounts in the left direction of the first protrusion portion 321, the second protrusion portion 322 and the third protrusion portion 323 are substantially the same. An outer diameter of the pin 321A is slightly smaller than an inner diameter of the first engaged hole 174 of the left holding part 7, and an outer diameter of the pin 322A is slightly smaller than a short diameter of the second engaged hole 175 of the left holding part 7.

As shown in FIG. 6, the right wall part 33 is erected upward from a right end portion of the bottom wall part 31. The right wall part 33 is substantially bilaterally symmetrical to the left wall part 32, and has a substantially heart shape, as seen from a right side. Like the left wall part 32, the right wall part 33 has a forward protruding part 38, a guide portion 381, a shaft supporting groove 36, tapered portions 361, a first protrusion portion 331, a second protrusion portion 332, a third protrusion portion 333 and the like. The forward protruding part 38 protrudes forward from a front end portion of the right wall part 33, and has an elongated plate shape, as seen from a right side. The guide portion 381 protrudes leftward from an upper end portion of the forward protruding part 38. The shaft supporting groove 36 has a rectangular shape that extends downwardly from a central portion in the front and rear direction of an upper end portion of the right wall part 33 and is vertically long, as seen from a side. A lower part of the shaft supporting groove 36 is located at a substantially central portion of the right wall part 33 in the upper and lower direction and is curved in a substantial arc shape. A width of the shaft supporting groove 36 is slightly greater than a width of the locked groove 35 of the left wall part 32. The tapered portions 361 are formed at both front and rear portions of an upper part of the shaft supporting groove 36, and each expand in a tapered shape from below to upper. A tip end face of the first protrusion portion 331 is provided with a pin 331A further protruding rightward. A tip end face of the second protrusion portion 332 is also provided with a pin 332A further protruding rightward. An outer diameter of the pin 331A is slightly smaller than an inner diameter of the first engaged hole (not shown) of the right holding part 8, and an outer diameter of the pin 332A is slightly smaller than a short diameter of the second engaged hole (not shown) of the right holding part 8.

Figure 12:
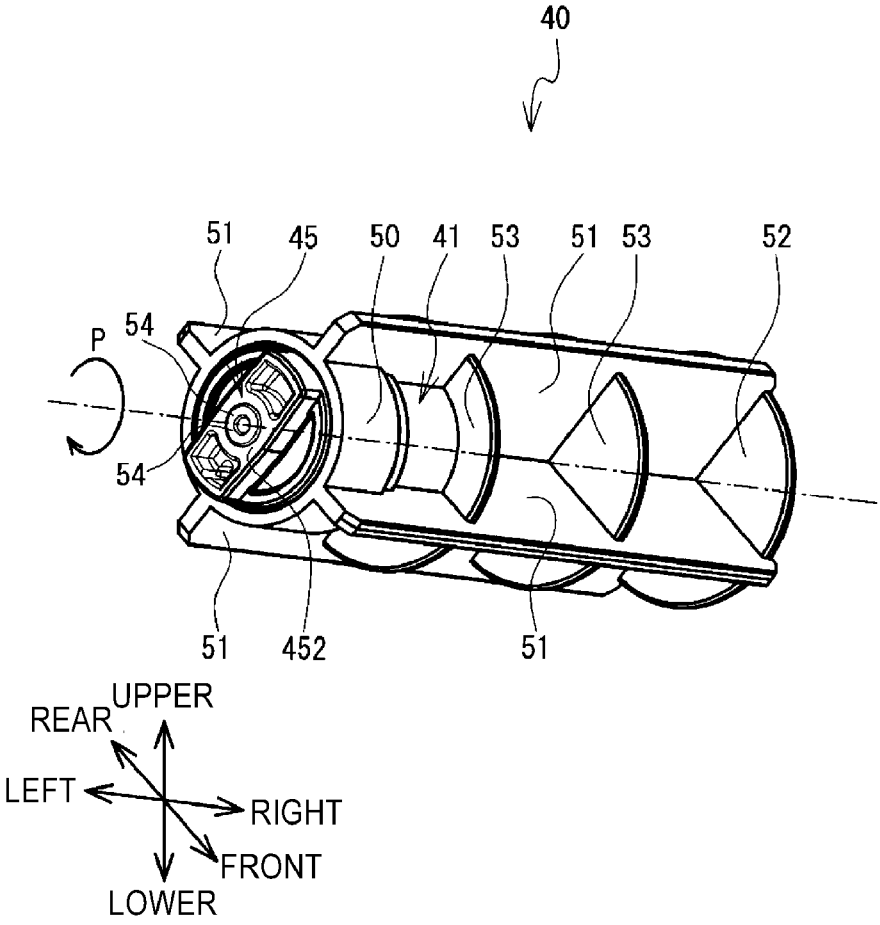
FIG. 12 is a perspective view of a roll holding member 40, as seen diagonally from the left front.
Figure 13:
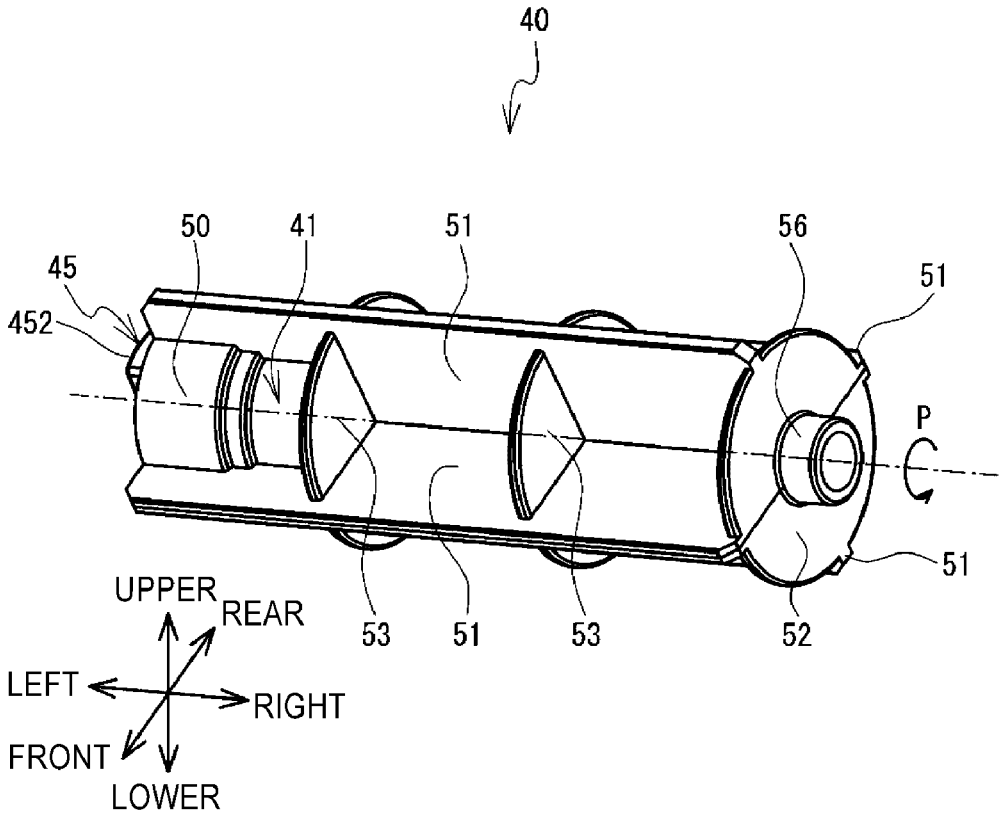
FIG. 13 is a perspective view of the roll holding member 40, as seen diagonally from the right front.
Figure 14:
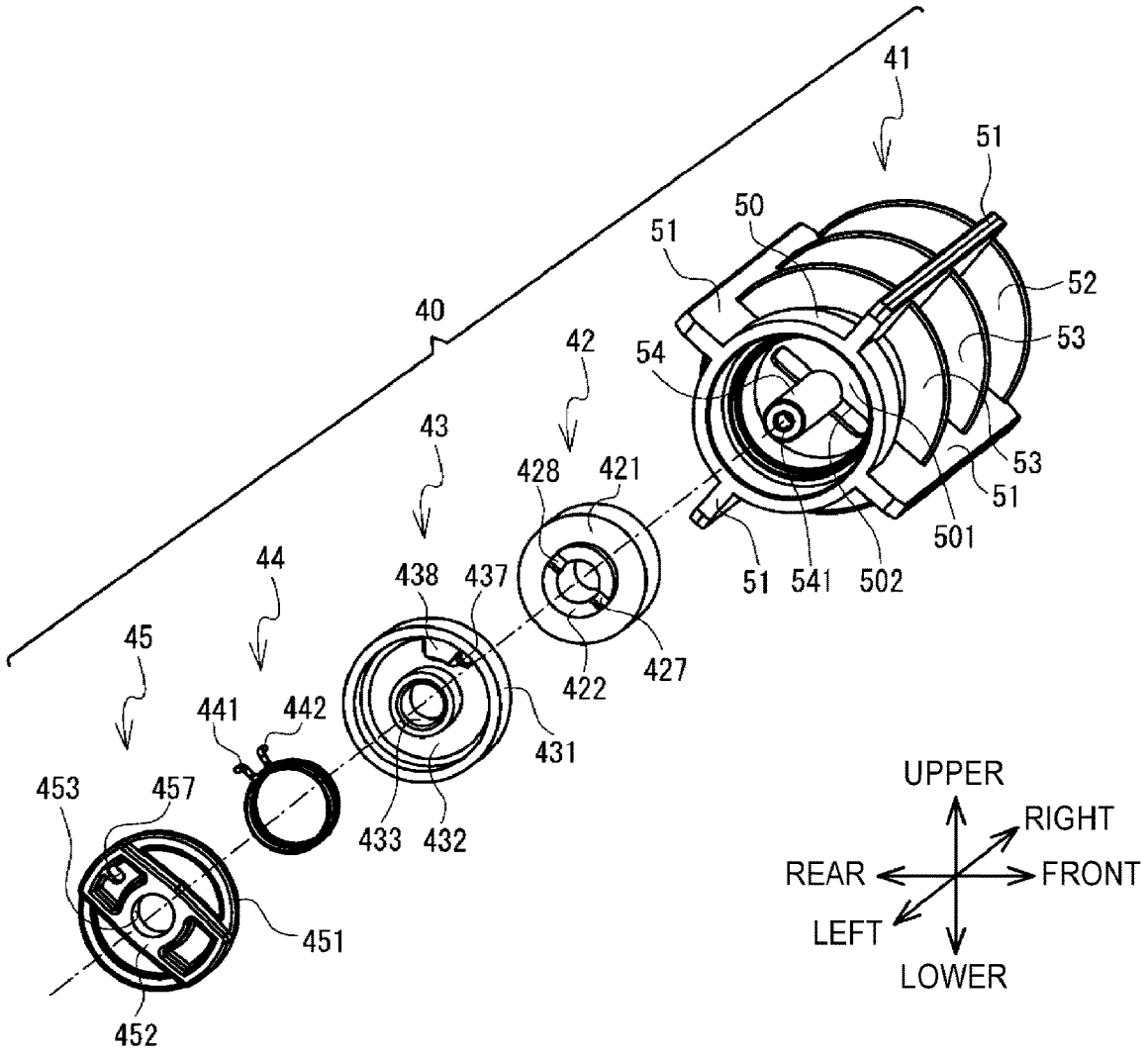
FIG. 14 is an exploded perspective view of the roll holding member 40, as seen diagonally from the left front.
Figure 15:
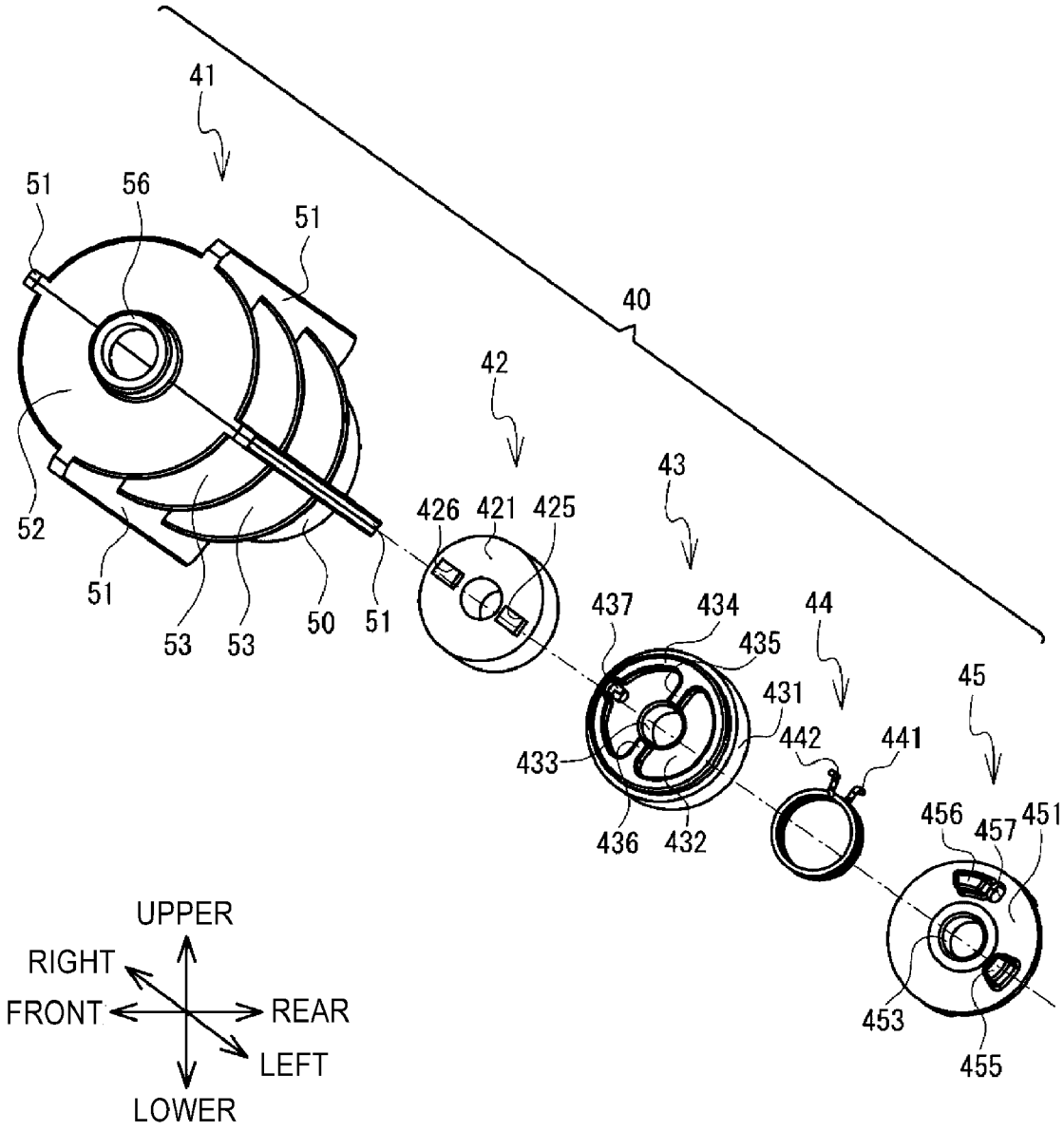
FIG. 15 is an exploded perspective view of the roll holding member 40, as seen diagonally from the right front.

A structure of the roll holding member 40 is described with reference to FIGS. 12 to 15. The roll holding member 40 shown in FIGS. 12 and 13 is configured by combining five components to be described later, and is a complex body having a substantially circular column shape extending in the right and left direction. As shown in FIGS. 14 and 15, the roll holding member 40 has a holding shaft 41, a torque limiter 42, an intermediate member 43, a torsion spring 44, and a flange member 45 in corresponding order from the right.

The holding shaft 41 is formed of a resin material, and has a substantially circular column shape extending in the right and left direction. As shown in FIGS. 12 to 15, the holding shaft 41 has a cylindrical part 50, four outer shape ribs 51, a circular flange 52, two reinforcement flanges 53, a left support shaft 54, a right support shaft 56 and the like. The cylindrical part 50 has a substantially bottomed cylindrical shape extending in the right and left direction and opening leftward. The four outer shape ribs 51 include four plates each having a substantially rectangular shape that is long in the right and left direction. When seeing the holding shaft 41 from an axial direction, the four outer shape ribs 51 protrude from an outer surface of the cylindrical part 50 in a cross direction, and intersect and connect with each other in a cross shape at a portion further extending rightward than the cylindrical part 50. The circular flange 52 is provided orthogonally to right end portions of the four outer shape ribs 51, and has a circular shape, as seen from a right side.

The two reinforcement flanges 53 each have a substantially circular shape as seen from an axial direction, and are provided to block each of the four outer shape ribs 51 therebetween in the vicinity of the right end portion of the cylindrical part 50 and in a substantially intermediate position between the cylindrical part 50 and the circular flange 52. The reinforcement flanges 53 reinforce the four outer shape ribs 51. The left support shaft 54 protrudes leftward along an axis from a center of a bottom portion 501 (refer to FIG. 14) on an inner side of the cylindrical part 50. The left support shaft 54 is formed with a central hole 541 extending rightward from a left end face. The bottom portion 501 is provided with a slit 502. The slit 502 is a long hole extending on both sides in a radial direction with the left support shaft 54 being positioned at a center thereof, and penetrates in the right and left direction. The right support shaft 56 protrudes rightward along an axis from a center of the circular flange 52, and has a substantially cylindrical shape.

The torque limiter 42 has a substantially ring shape and a size that can be inserted inside of the cylindrical part 50. In the meantime, as the torque limiter 42, a well-known torque limiter can be adopted. The torque limiter 42 has a main body ring portion 421 and a driven ring portion 422. The main body ring portion 421 has a substantially ring shape. A right end face of the main body ring portion 421 is provided with a pair of convex portions 425 and 426 (refer to FIG. 15) protruding rightward. The pair of convex portions 425 and 426 is provided in positions facing each other with a central hole being interposed therebetween. The driven ring portion 422 has a substantially ring shape of which a diameter is smaller than the main body ring portion 421, and is inserted to an inner side of the central hole of the main body ring portion 421. A left end portion of the driven ring portion 422 protrudes leftward on a left end-side of the main body ring portion 421 (refer to FIG. 14). The left end portion of the driven ring portion 422 is provided with a pair of concave portions 427 and 428. The pair of concave portions 427 and 428 is provided in positions facing each other with a central hole being interposed therebetween.

In the torque limiter 42, when torque at which the driven ring portion 422 is rotated with respect to the main body ring portion 421 is equal to or less than set torque, for example, a rotating force of the driven ring portion 422 is transmitted to the main body ring portion 421. When the rotating torque exceeds the set torque, the driven ring portion 422 is slip with respect to the main body ring portion 421, so that the transmission of the rotating force is interrupted. The set torque becomes a resistance force when the driven ring portion 422 is rotated with respect to the main body ring portion 421.

The intermediate member 43 has a main body tube portion 431, a shaft tube portion 433, a cylindrical rib 434, a pair of engaging ribs 435 and 436, a spring locking hole 437, and an engaging protrusion 438. The main body tube portion 431 has a short-axis cylindrical shape opening leftward. The main body tube portion 431 has a substantially ring-shaped bottom portion 432. The shaft tube portion 433 extends leftward from an inner edge portion of a central hole of the bottom portion 432 on an inner side of the main body tube portion 431, and has a substantially cylindrical shape. The cylindrical rib 434 (refer to FIG. 15) protrudes rightward from an outer peripheral edge of an outer surface (right surface) of the bottom portion 432. The pair of engaging ribs 435 and 436 extends in a substantially linear shape from facing positions facing on an inner edge portion of the cylindrical rib 434 toward the shaft tube portion 433, and protrudes rightward from the outer surface of the bottom portion 432. The spring locking hole 437 penetrates in the right and left direction on a front side of the bottom portion 432 and in a position overlapping the inner edge portion of the cylindrical rib 434. The engaging protrusion 438 (refer to FIG. 14) is provided on an inner surface of the bottom portion 432 in the vicinity of the clockwise direction-side of the spring locking hole 437, as seen from a left side. The engaging protrusion 438 protrudes leftward.

The torsion spring 44 has a coil shape, and has a pair of arm portions 441 and 442. The pair of arm portions 441 and 442 is both end portions of the torsion spring 44. A tip end portion of the arm portion 441 is bent leftward, and a tip end portion of the arm portion 442 is bent rightward. When the pair of arm portions 441 and 442 is moved away from each other in a circumferential direction, i.e., is moved in a direction of winding the torsion spring 44, the torsion spring 44 generates an biasing force of biasing the pair of arm portions 441 and 442 toward each other, i.e., in a direction of unwinding the torsion spring 44. The biasing force of the torsion spring 44 is adjusted to be weaker than the set torque of the torque limiter 42.

The flange member 45 has a disk portion 451, a rectangular portion 452, a shaft hole 453, a first protrusion 455, a second protrusion 456, a spring locking hole 457 and the like. The disk portion 451 has a substantially disk shape having a thickness in the right and left direction, and a size that can be inserted inside of the cylindrical part 50. The rectangular portion 452 (refer to FIG. 14) has a substantially rectangular shape extending radially on a left surface of the disk portion 451, as seen from a left side surface, and protrudes leftward. The shaft hole 453 is formed to penetrate central portions of the disk portion 451 and the rectangular portion 452. The first protrusion 455 and the second protrusion 456 (refer to FIG. 15) protrude rightward in positions spaced in a circumferential direction on a right surface of the disk portion 451. A spaced angle between the first protrusion 455 and the second protrusion 456 about the shaft hole 453 is about 120° . The spring locking hole 457 is provided in the vicinity of the clockwise direction-side of the second protrusion 456, as seen from a right side, and penetrates the disk portion 451 in the right and left direction.

An example of a method of assembling the roll holding member 40 is described with reference to FIGS. 12 to 15. As shown in FIGS. 14 and 15, an operator accommodates the torque limiter 42, the intermediate member 43, the torsion spring 44, and the flange member 45 inside of the cylindrical part 50 of the holding shaft 41. First, the operator inserts the torque limiter 42 into the cylindrical part 50 of the holding shaft 41. The operator inserts the left support shaft 54 extending from the bottom portion 501 of the cylindrical part 50 into the central shaft hole of the driven ring portion 422 of the torque limiter 42. At this time, the operator engages the pair of convex portions 425 and 426 provided on the right end face of the main body ring portion 421 of the torque limiter 42 to the slit 502 of the bottom portion 501. Thereby, the main body ring portion 421 of the torque limiter 42 is integrated with the holding shaft 41, and the circumferential rotation of the holding shaft 41 with respect to the cylindrical part 50 is limited.

Subsequently, the operator inserts the intermediate member 43 into the cylindrical part 50 having the torque limiter 42 inserted therein. The operator inserts the left support shaft 54 to the inner side of the shaft tube portion 433 of the intermediate member 43. Thereby, the intermediate member 43 is rotatably supported to the left support shaft 54. At this time, the pair of engaging ribs 435 and 436 provided on the outer surface (right surface) of the bottom portion 432 of the intermediate member 43 is engaged to the pair of concave portions 427 and 428 provided at the left end portion of the driven ring portion 422 of the torque limiter 42. Thereby, the intermediate member 43 is integrated with the driven ring portion 422.

Subsequently, the operator inserts the torsion spring 44 into the cylindrical part 50 having the intermediate member 43 inserted therein. Then, the operator inserts the shaft tube portion 433 to the inner side of the torsion spring 44. The torsion spring 44 is accommodated inside of the main body tube portion 431 of the intermediate member 43. At this time, the operator inserts the tip end portion of the arm portion 442 of the torsion spring 44 into the spring locking hole 437 of the intermediate member 43.

Subsequently, the operator inserts the flange member 45 into the cylindrical part 50 having the torsion spring 44 inserted therein. The operator inserts the left support shaft 54 into the shaft hole 453 of the flange member 45. Thereby, the flange member 45 is rotatably supported to the left support shaft 54. The operator inserts the tip end portion of the arm portion 441 of the torsion spring 44 into the spring locking hole 457 of the flange member 45. Thereby, the torsion spring 44 is moved in a direction in which the pair of arm portions 441 and 442 becomes away from each other, thereby generating the biasing force. Thereby, the engaging protrusion 438 of the intermediate member 43 and the second protrusion 456 of the flange member come into contact in the circumferential direction.

In this way, the torque limiter 42, the intermediate member 43, the torsion spring 44, and the flange member 45 are accommodated inside of the cylindrical part 50 of the holding shaft 41. In the meantime, rather than the above accommodation method, for example, the torque limiter 42, the intermediate member 43, the torsion spring 44, and the flange member 45 may be first combined and integrated, which is then inserted into the cylindrical part 50. That is, the accommodation sequence may be changed. Finally, the operator fastens a screw (not shown) into the central hole 541 of the left support shaft 54 inserted in the shaft hole 453 of the flange member 45, via a washer (not shown). Thereby, the torque limiter 42, the intermediate member 43, the torsion spring 44, and the flange member 45 are prevented from coming off with respect to the left support shaft 54. In this way, the assembling of the roll holding member 40 is completed.

The operator internally fits the roll holding member 40 to the shaft center hole of the roll M2 (refer to FIG. 4). An outer end portion of each of the four outer shape ribs 51 of the holding shaft 41 comes into contact with an inner surface of the shaft center hole. Thereby, the holding shaft 41 of the roll holding member 40 is integrated with the core of the roll M2. In the meantime, a plurality of the holding shafts 41 of the roll holding member 40, in which the protruding amounts of the outer shape ribs 51 are varied, may be prepared in accordance with the size of the inner diameter of the shaft center hole of the roll.

Figure 9:
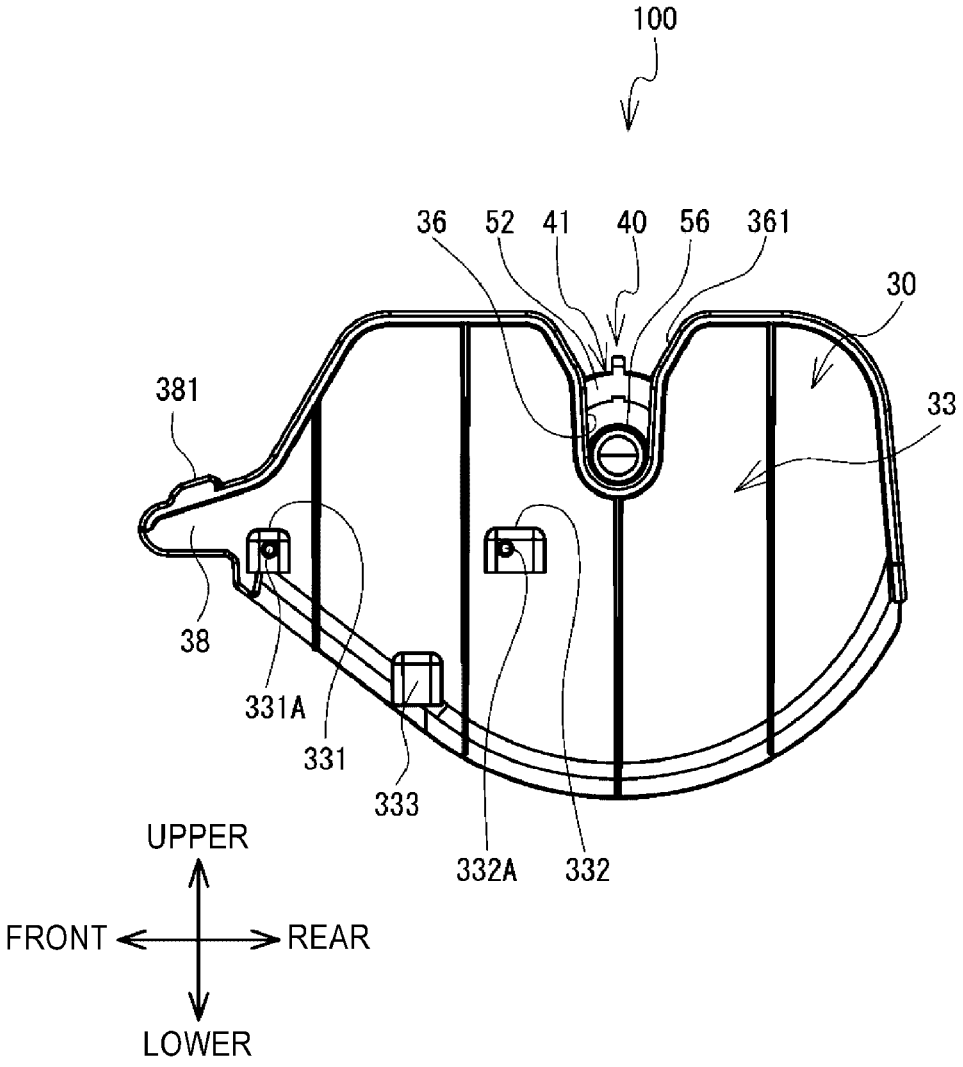
FIG. 9 is a right side view of the attachment 100.
Figure 10:
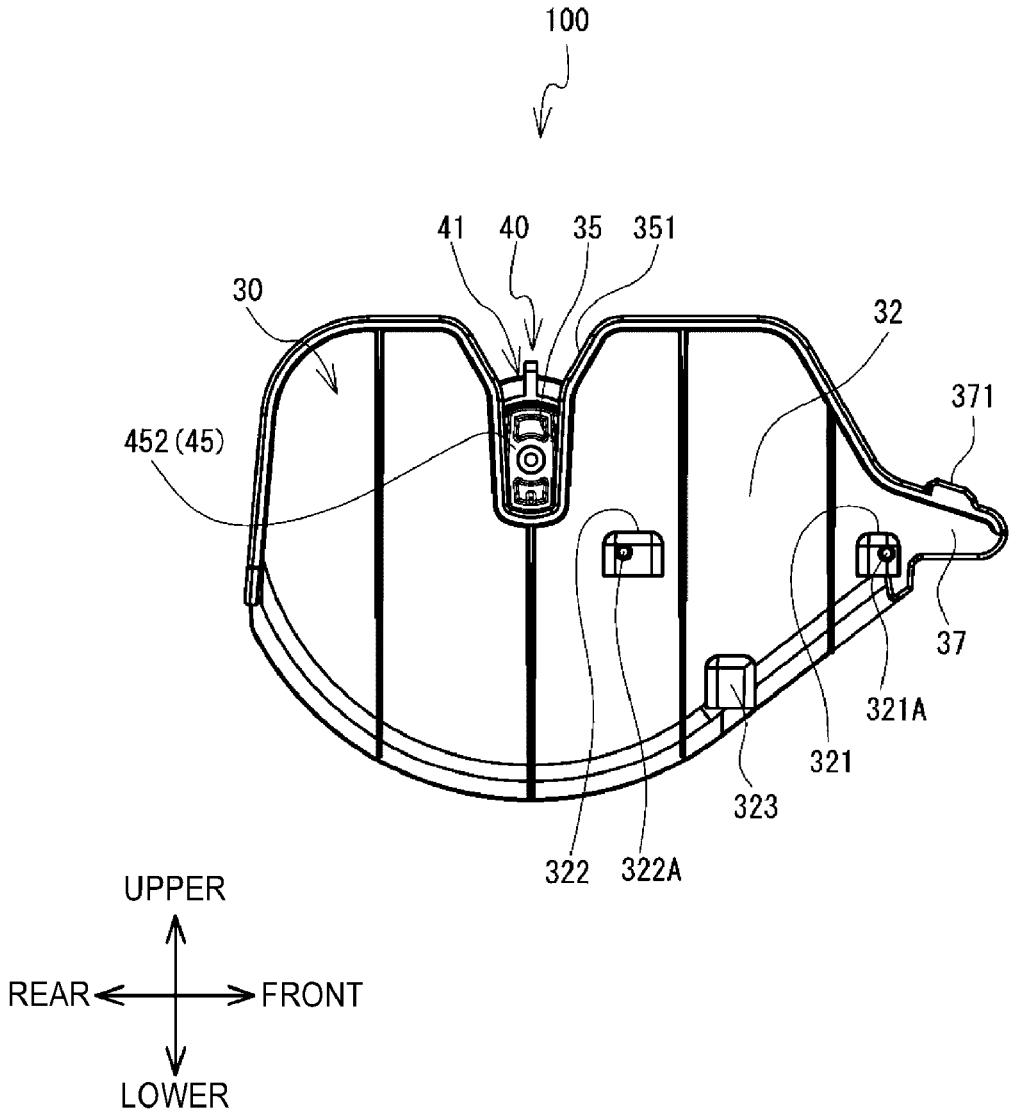
FIG. 10 is a left side view of the attachment 100.
Figure 11:
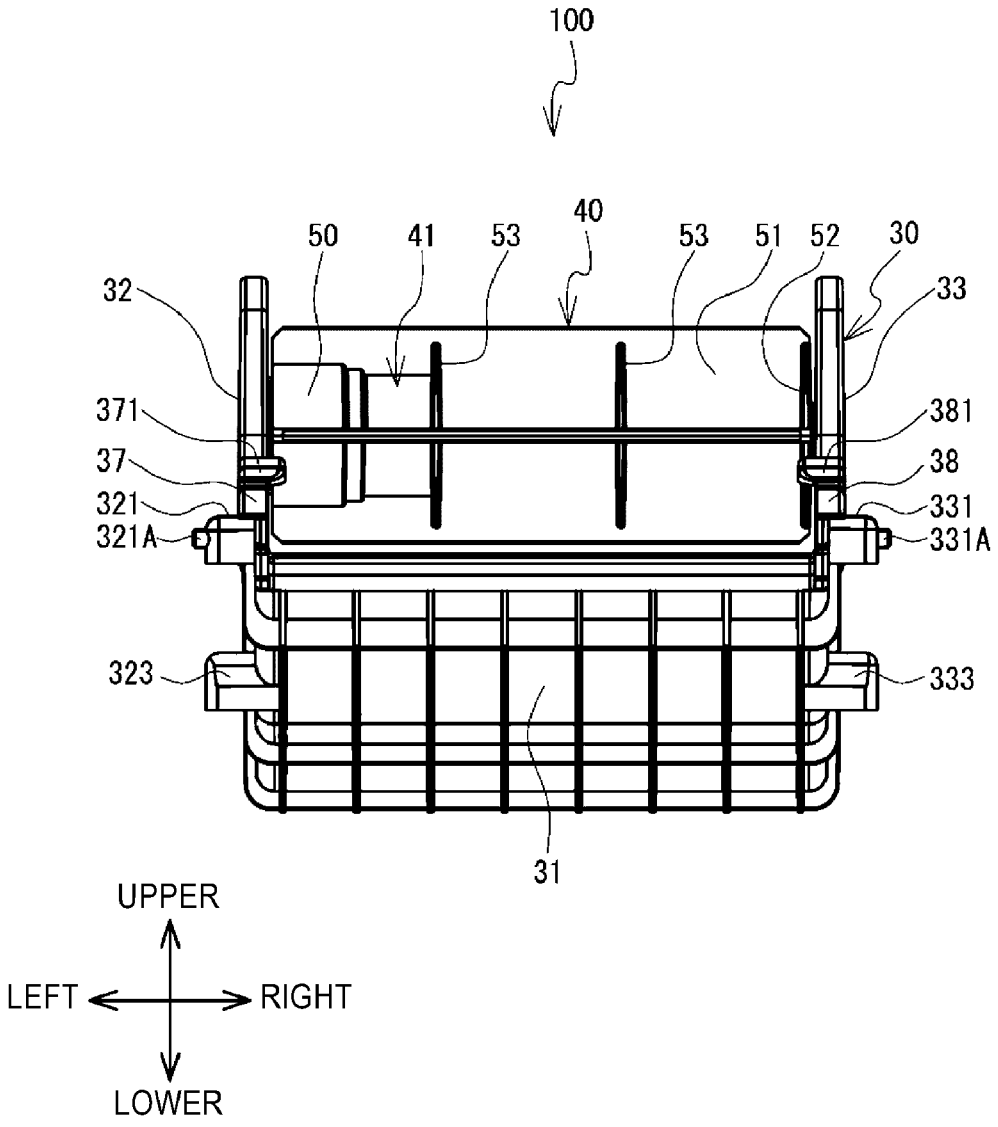
FIG. 11 is a front view of the attachment 100.

An example of a method of attaching the roll holding member 40 to the housing 30 is described with reference to FIGS. 6 to 13. In the meantime, the roll holding member 40 is internally fitted to the shaft center hole of the roll M2, and is then attached to the housing 30. At the left end portion of the roll holding member 40, the rectangular portion 452 protrudes leftward from the cylindrical part 50 of the holding shaft 41 (refer to FIG. 12). At the right end portion of the roll holding member 40, the right support shaft 56 protrudes rightward (refer to FIG. 13). The user attaches the roll holding member 40 from the upper of the housing 30. As shown in FIG. 10, the user inserts the rectangular portion 452 of the flange member 45 of the roll holding member 40 into the locked groove 35 of the left wall part 32 of the housing 30 from above. The rectangular portion 452 is fitted to the locked groove 35 with no substantial gap. When the rectangular portion 452 is inserted into the locked groove 35, the tapered portions 351 guide the rectangular portion 452 to the locked groove 35. Thereby, the rectangular portion 452 can be easily inserted into the locked groove 35. On the other hand, as shown in FIG. 9, the user inserts the right support shaft 56 of the roll holding member 40 into the shaft supporting groove 36 of the right wall part 33 of the housing 30 from above. The right support shaft 56 is supported to be rotatable in the shaft supporting groove 36. The roll holding member 40 is rotatably supported inside of the housing 30 (refer to FIG. 11). Thereby, the attachment of the roll holding member 40 to the housing 30 is completed.

An example of a method of attaching the housing 30 to the printing apparatus 1 is described with reference to FIGS. 3 to 5. The user operates the roll holding mechanism 15 (refer to FIG. 3) in the similar manner to the case where the roll M1 is mounted to the accommodation part 11. The user moves the left holding part 7 and the right holding part 8 away from each other (the outer sides in the right and left direction) against the biasing force of the coil springs 28 and 29. The user arranges the housing 30 between the left holding part 7 and the right holding part 8 (refer to FIG. 5). When the user releases the operation on the left holding part 7 and the right holding part 8, the left holding part 7 and the right holding part 8 are moved toward each other by the biasing force of the coil springs 28 and 29.

At this time, the pin 321A (refer to FIG. 7) of the first protrusion portion 321 provided on the left wall part 32 of the housing 30 is engaged to the first engaged hole 174 of the left holding part 7. The pin 322A (refer to FIG. 7) of the second protrusion portion 322 provided on the left wall part 32 of the housing 30 is engaged to the second engaged hole 175 of the left holding part 7. In addition, the third protrusion portion 323 (refer to FIG. 7) provided on the left wall part 32 of the housing 30 comes into contact with the facing surface 17 of the left holding part 7. The fan-shaped portion 172 of the left holding part 7 comes into contact with the outer surface of the left wall part 32 of the housing 30.

On the other hand, the pin 331A (refer to FIG. 6) of the first protrusion portion 331 provided on the right wall part 33 of the housing 30 is engaged to the first engaged hole (not shown) of the right holding part 8. The pin 332A (refer to FIG. 6) of the second protrusion portion 332 provided on the right wall part 33 of the housing 30 is engaged to the second engaged hole (not shown) of the right holding part 8. In addition, the third protrusion portion 333 (refer to FIG. 6) provided on the right wall part 33 of the housing 30 comes into contact with the facing surface 18 of the right holding part 8. The fan-shaped portion 182 of the right holding part 8 comes into contact with the outer surface of the right wall part 33 of the housing 30.

In this way, the housing 30 is positioned with respect to the first engaged hole 174 and the second engaged hole 175 of the left holding part 7 by the pin 321A of the first protrusion portion 321 and the pin 322A of the second protrusion portion 322 provided on the outer surface of the left wall part 32, and is positioned with respect to the first engaged hole (not shown) and the second engaged hole (not shown) of the right holding part 8 by the pin 331A of the first protrusion portion 331 and the pin 332A of the second protrusion portion 332 provided on the outer surface of the right wall part 33. The housing 30 is sandwiched between the left holding part 7 and the right holding part 8 by the biasing force of the coil springs 28 and 29 with being positioned with respect to the left holding part 7 and the right holding part 8. Thereby, the housing 30 is securely attached without being positionally misaligned between the left holding part 7 and the right holding part 8. Finally, the user pulls out the linerless tape forward from the roll M2 held by the roll holding member 40, and causes the linerless tape to pass below the guide portion 371 of the left wall part 32 of the housing 30 and below the guide portion 381 of the right wall part 33 of the housing 30. Thereby, the housing 30 can prevent the linerless tape from floating.

In the meantime, when the housing 30 is attached to the roll holding mechanism 15, a slight gap is formed between a lower surface of the bottom wall part 31 of the housing 30 and an upper surface of the main body cover 10 of the printing apparatus 1. Thereby, the housing 30 is securely attached to the roll holding mechanism 15 without coming into contact with the main body cover 10 even if there is an error in shape dimension.

A rotating operation of the roll holding member 40 that is performed upon printing of the roll M2 is described with reference to FIGS. 4 and 12 to 15. As shown in FIG. 4, in a state where the roll holding member 40 is attached to the housing 30, the right support shaft 56 of the holding shaft 41 is supported by the shaft supporting groove 36 of the right wall part 33 on the right end-side of the roll holding member 40 (refer to FIG. 9). On the left end-side of the roll holding member 40, the rectangular portion 452 of the flange member 45 is fitted to the locked groove 35 of the left wall part 32 of the housing 30 (refer to FIG. 10). Therefore, the rectangular portion 452 is locked to the locked groove 35 in the circumferential direction about the left support shaft 54, so that the position of the flange member 45 is fixed. That is, the flange member 45 is not rotated in the circumferential direction. The left support shaft 54 (refer to FIG. 14) is rotatably supported to the flange member 45 in the position-fixed state. Thereby, the holding shaft 41 can rotate with respect to the housing 30, so that the roll M2 held by the holding shaft 41 can also rotate integrally.

When a printing operation of the printing apparatus 1 starts, the platen roller 13 is rotated by drive of the conveyor motor (not shown). The linerless tape is pulled out and conveyed forward from the roll M2 (refer to FIG. 4). The linerless tape is pulled out forward, so that the holding shaft 41 starts to rotate in the clockwise direction, as seen from a left side (refer to a P direction in FIGS. 12 and 13). In association with this, the torque limiter 42 and the intermediate member 43 shown in FIG. 14 are also rotated integrally with the holding shaft 41. The intermediate member 43 is rotated, so that the arm portion 442 of the torsion spring 44 locked to the intermediate member 43 is also rotated in the same direction but the flange member 45 to which the arm portion 441 is locked is not rotated. Thereby, the torsion spring 44 is bent in a winding direction, so that the force weaker than the set torque of the torque limiter 42 is biased to the intermediate member 43 in an opposite direction to the rotating direction of the holding shaft 41.

Upon start of the printing operation, the engaging protrusion 438 (refer to FIG. 14) of the intermediate member 43 is located in a position in which it is in contact with the second protrusion 456 (refer to FIG. 15) of the flange member 45. When the intermediate member 43 is rotated together with the holding shaft 41 with respect to the flange member 45 in the clockwise direction, as seen from a left side, the engaging protrusion 438 is rotated in the same direction about the left support shaft 54. Thereby, the engaging protrusion 438 is rotated until it comes into contact with the first protrusion 455 of the flange member 45. Therefore, since the torsion spring 44 is bent in a winding direction, it biases the intermediate member 43 in the opposite direction to the rotating direction of the holding shaft 41.

When the engaging protrusion 438 comes into contact with the first protrusion 455, the intermediate member 43 and the flange member 45 are integrated. Herein, since the holding shaft 41 continues to rotate but the intermediate member 43 does not rotate, torque exceeding the set torque is applied to the torque limiter 42. At this time, the main body ring portion 421 engaged to the holding shaft 41 is slid with respect to the driven ring portion 422 of the torque limiter 42 engaged to the intermediate member 43. Thereby, while the linerless tape is pulled out forward from the roll M2, the roll holding member 40 can apply predetermined tension to the linerless tape by the set torque of the torque limiter 42. Thereby, when pulling out the linerless tape, the force does not become non-uniform depending on the outer diameter (a wound length of the linerless tape) of the roll M2, so that the attachment 100 can stabilize conveyance accuracy of the linerless tape.

After executing the printing operation, the printing apparatus 1 reverses the linerless tape before a next printing operation, so as to reduce a leading margin corresponding to a distance between the thermal head 14 and the cutting part. At this time, since the tension applied by the torque limiter 42 is released, the engaging protrusion 438 of the intermediate member 43 is rotated from a position in which it is in contact with the first protrusion 455 of the flange member 45 to a position in which it comes into contact with the second protrusion 456 by the biasing force of the torsion spring 44. That is, since the intermediate member 43 is reversed by the biasing force of the torsion spring 44, the torque limiter 42 and the holding shaft 41 are also reversed. The holding shaft 41 is reversed, so that the linerless tape can be wound. Thereby, since the loosening is not caused in the linerless tape, the printing apparatus 1 can execute favorably a next printing operation.

Figure 3:
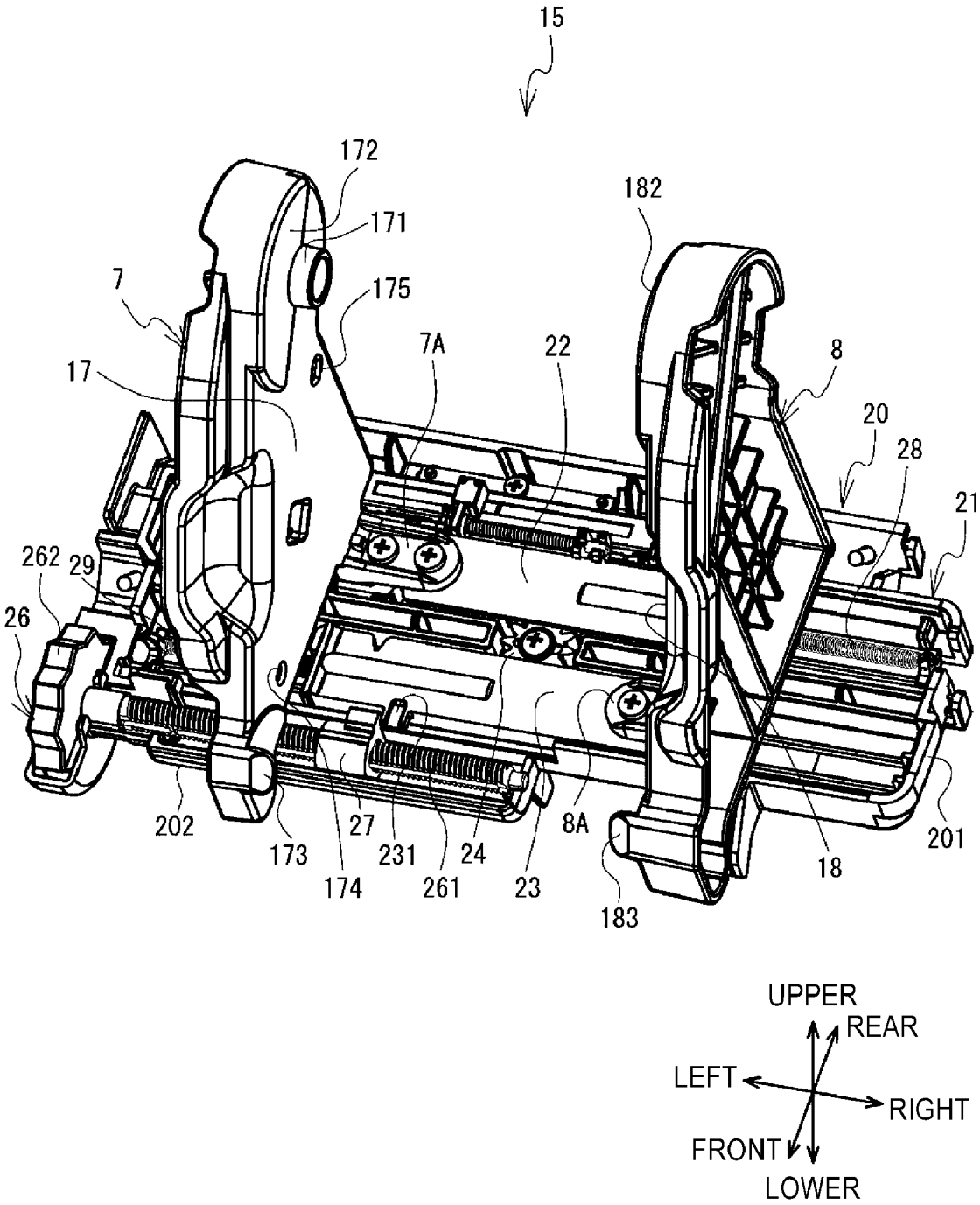
FIG. 3 is a perspective view of a roll holding mechanism 15.

In the above descriptions, the left holding part 7 and the right holding part 8 of the roll holding mechanism 15 shown in FIG. 3 are examples of "the holding part" of the present disclosure. The first engaged hole 174 and the second engaged hole 175 provided to the left holding part 7 and the first engaged hole and the second engaged hole provided to the right holding part 8 are examples of "the engaged part" of the present disclosure. The pin 321A of the first protrusion portion 321 and the pin 322A of the second protrusion portion 322 provided to the left wall part 32 of the housing 30 and the pin 331A of the first protrusion portion 331 and the pin 332A of the second protrusion portion 332 provided to the right wall part 33 are examples of "the engaging part" of the present disclosure. The locked groove 35 provided to the left wall part 32 of the housing 30 and the shaft supporting groove 36 provided to the right wall part 33 are examples of "the support part" of the present disclosure. The locked groove 35 is an example of "the locked portion" of the present disclosure. The left wall part 32 and the right wall part 33 of the housing 30 are examples of "the sidewall part" of the present disclosure. In the roll holding member 40, the left support shaft 54 is an example of "the first support shaft" of the present disclosure. The flange member 45 is an example of "the rotation locking member" of the present disclosure. The right support shaft 56 is an example of "the second support shaft" of the present disclosure. The torque limiter 42 is an example of "the resistance applying part" of the present disclosure. The torsion spring 44 is an example of "the biasing member" of the present disclosure.

As described above, the attachment 100 of the first embodiment is attached, in a detachable manner, to the accommodation part 11 of the printing apparatus 1 and supports the roll including the print medium which is wound. The attachment 100 includes the housing 30 and the roll holding member 40. The housing 30 has a substantially box shape of which an upper part is opened, and accommodates the roll inside thereof in a replaceable manner. The roll holding member 40 is attached to the housing 30 in a state of being internally fitted to the shaft center hole of the roll. The housing 30 rotatably supports the roll holding member 40 internally fitted to the shaft center hole of the roll by the locked groove 35 provided to the left holding part 7 and the shaft supporting groove 36 provided to the right holding part 8.

The outer surface of the left wall part 32 of the housing 30 is provided with the first protrusion portion 321 and the second protrusion portion 322, and the outer surface of the right wall part 33 is also provided with the first protrusion portion 331 and the second protrusion portion 332. The accommodation part 11 of the printing apparatus 1 is provided with the roll holding mechanism 15. The roll holding mechanism 15 includes the left holding part 7 and the right holding part 8. The left holding part 7 is provided with the first engaged hole 174 and the second engaged hole 175, and the right holding part 8 is also provided with the first engaged hole and the second engaged hole.

The housing 30 is arranged between the left holding part 7 and the right holding part 8. At this time, the pin 321A of the first protrusion portion 321 of the left wall part 32 is engaged to the first engaged hole 174 of the left holding part 7, and the pin 322A of the second protrusion portion 322 of the left wall part 32 is engaged to the second engaged hole 175 of the left holding part 7. Also for the right wall part 33, similarly, the pin 331A of the first protrusion portion 331 of the right wall part 33 is engaged to the first engaged hole of the right holding part 8, and the pin 332A of the second protrusion portion 332 of the right wall part 33 is engaged to the second engaged hole of the right holding part 8. Thereby, in the accommodation part 11, the housing 30 is positionally determined to a predetermined value. Therefore, even in a case where the roll cannot be directly mounted to the accommodation part 11 of the printing apparatus 1, by attaching the housing 30 to the accommodation part 11 of the printing apparatus 1, the roll can be mounted to the accommodation part 11. Since the housing 30 is positionally determined to a predetermined position in the accommodation part 11, the printing apparatus 1 can favorably perform the printing on the tape pulled out from the roll without positional misalignment.

Figure 16:
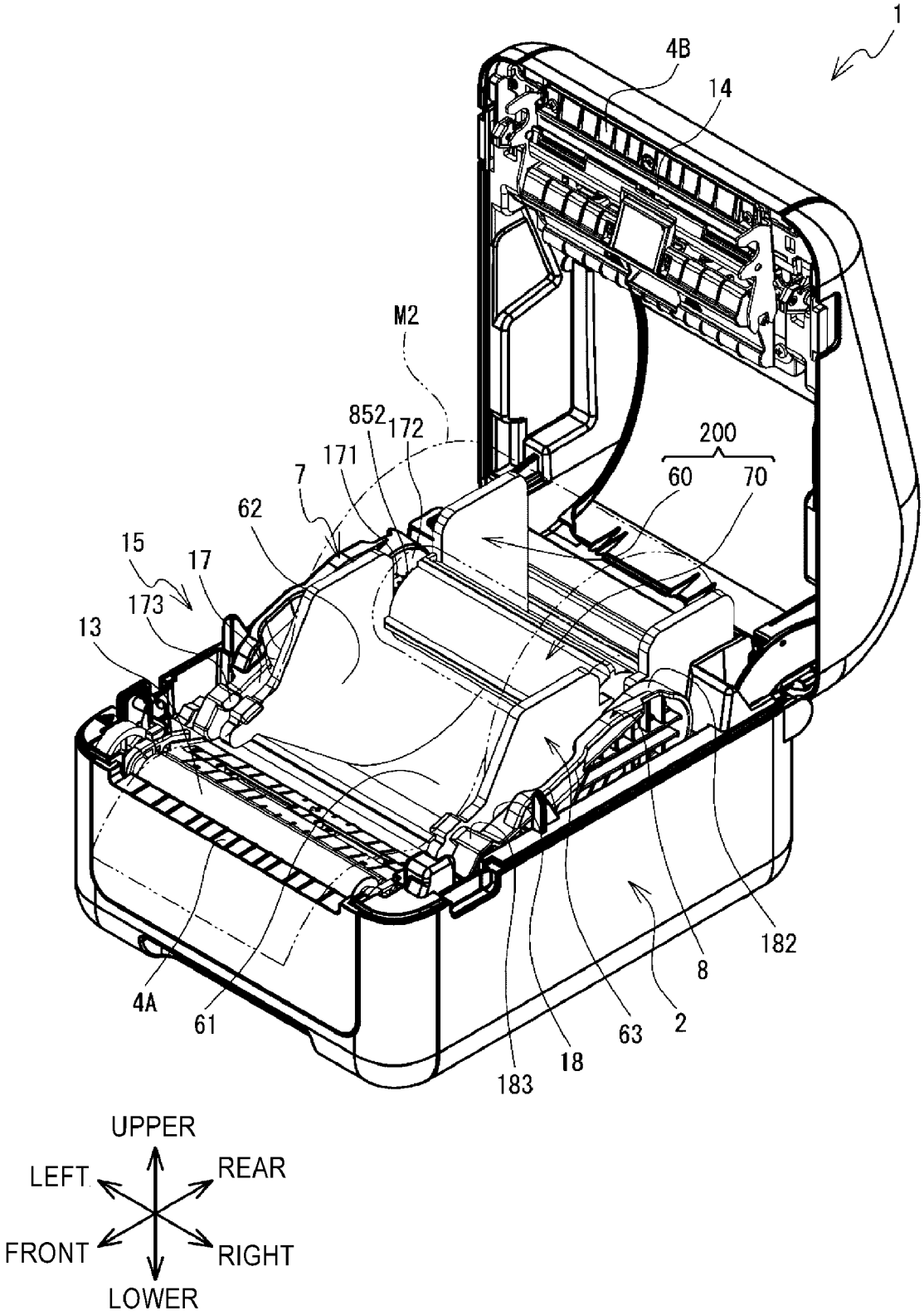
FIG. 16 is a perspective view of the printing apparatus 1 to which an attachment 200 is attached.

A second embodiment of the present disclosure is described with reference to FIGS. 16 to 23. An attachment 200 of the second embodiment shown in FIG. 16 is a modified embodiment of the attachment 100 of the first embodiment. The attachment 200 includes a housing 60 and a roll holding member 70. With the attachment 200, the user can mount a roll that cannot be directly mounted to the roll holding mechanism 15. Also, the roll M2 is mounted to the roll holding mechanism 15 of the printing apparatus 1, so that the loosening of the linerless tape can be prevented during the conveying in the reverse direction, like the first embodiment.

Figure 17:
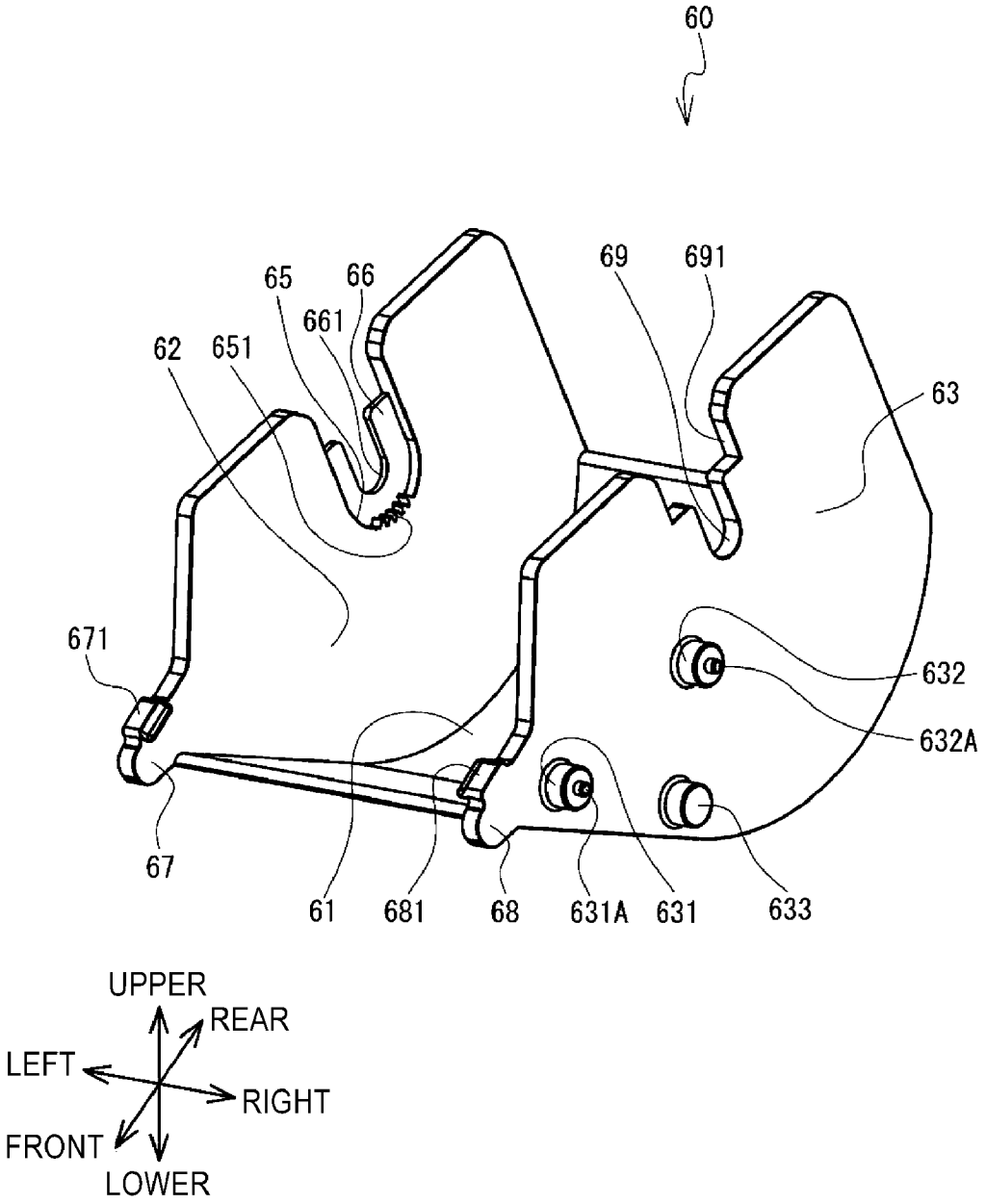
FIG. 17 is a perspective view of a housing 60, as seen diagonally from the right front.

A structure of the housing 60 is described with reference to FIG. 17. In the meantime, the housing 60 shown in FIG. 17 is shown with a posture at which it is attached to the roll holding mechanism 15. The housing 60 has a substantially box shape of which an upper part is opened, and can accommodate therein rolls of diverse sizes, like the housing 30 of the first embodiment. The housing 60 has a bottom wall part 61, a left wall part 62, and a right wall part 63. The bottom wall part 61 has a substantially rectangular shape that is long in the front and rear direction, as seen from above, and a central portion thereof is curved downwardly in a substantial arc shape, as seen from a side.

The left wall part 62 is erected upward from a left end portion of the bottom wall part 61, and has a substantially heart shape, as seen from a left side. A lower end portion of the left wall part 62 is curved in an arc shape. An upper end portion of the left wall part 62 has a substantially linear shape extending in the front and rear direction except a central portion in the front and rear direction. The left wall part 62 has a forward protruding part 67, a guide portion 671, a groove 65, a shaft supporting plate part 66, a first protrusion portion (not shown), a second protrusion portion (not shown), a third protrusion portion (not shown) and the like. The forward protruding part 67 protrudes forward from a front end portion of the left wall part 62, and has an elongated plate shape as seen from a left side. The guide portion 671 protrudes rightward from an upper end portion of the forward protruding part 67. The groove 65 has a rectangular shape that extends downwardly from a central portion in the front and rear direction of the upper end portion of the left wall part 62 and is vertically long, as seen from a side, and a lower end portion thereof is curved in an arc shape. The shaft supporting plate part 66 is provided along a left end-side in a thickness of an inner edge portion on a lower side of the groove 65, and has a substantial U-shape, as seen from a left side. An inner peripheral part of the shaft supporting plate part 66 is formed with a shaft supporting groove portion 661 having a substantial U-shape, as seen from a left side. In the inner edge portion of the lower end portion of the groove 65, a right part except the shaft supporting plate part 66 is provided with a locked portion 651 having a gear shape. The first protrusion portion, the second protrusion portion and the third protrusion portion are provided on a left side surface (outer surface) of the left wall part 62 at the same positions as the first protrusion portion 321, the second protrusion portion 322 and the third protrusion portion 323 (refer to FIG. 7) provided to the left wall part 32 of the first embodiment, and protrude leftward.

The right wall part 63 is erected upward from a right end portion of the bottom wall part 61. The right wall part 63 is substantially bilaterally symmetrical to the left wall part 62, and has a substantial heart shape, as seen from a right side. The right wall part 63 has also a forward protruding part 68, a guide portion 681, a shaft supporting groove 69, a widened portion 691, a first protrusion portion 631, a second protrusion portion 632, a third protrusion portion 633 and the like, like the left wall part 62. The forward protruding part 68 protrudes forward from a front end portion of the right wall part 63, and has an elongated plate shape, as seen from a right side. The guide portion 681 protrudes leftward from an upper end portion of the forward protruding part 68. The shaft supporting groove 69 has a rectangular shape that extends downwardly from a central portion in the front and rear direction of an upper end portion of the right wall part 63 and is vertically long, as seen from a side. A lower part of the shaft supporting groove 69 is located at a substantially central portion of the right wall part 63 in the upper and lower direction and is curved in a substantially arc shape. A width of the shaft supporting groove 69 is substantially the same as a width of the shaft supporting groove portion 661 of the left wall part 62. The widened portion 691 is provided on an upper side of the shaft supporting groove 69, and is formed wider than the shaft supporting groove 69.

The first protrusion portion 631, the second protrusion portion 632, and the third protrusion portion 633 are provided on a right side surface (outer surface) of the right wall part 63 at the same positions as the first protrusion portion 331, the second protrusion portion 332 and the third protrusion portion 333 (refer to FIG. 6) provided to the right wall part 33 of the first embodiment, and protrude rightward in a substantially circular column shape. A tip end face of the first protrusion portion 631 is provided with a pin 631A further protruding rightward. A tip end face of the second protrusion portion 632 is also provided with a pin 632A further protruding rightward. In the meantime, the first protrusion portion, the second protrusion portion and the third protrusion portion provided to the left wall part 62 are bilaterally symmetrical to the first protrusion portion 631, the second protrusion portion 632 and the third protrusion portion 633 provided to the right wall part 63.

Figure 18:
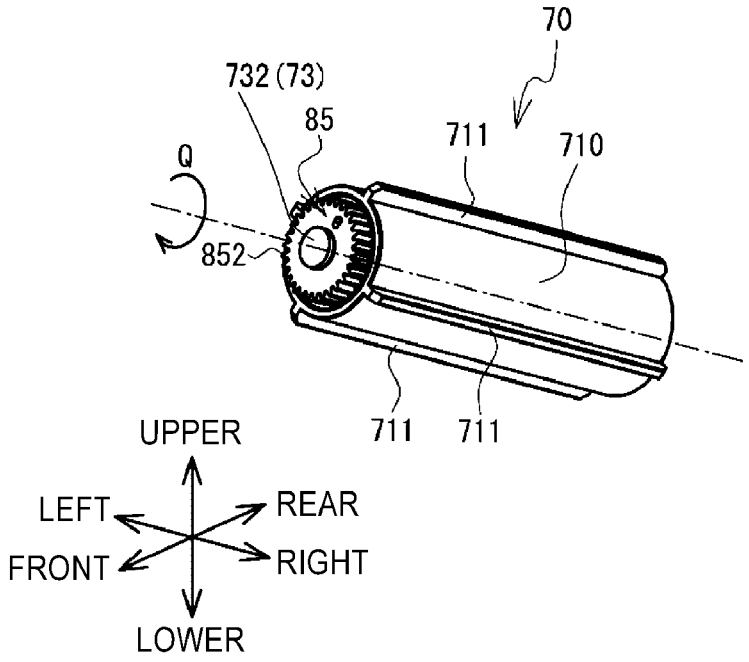
FIG. 18 is a perspective view of a roll holding member 70, as seen diagonally from the left front.
Figure 19:
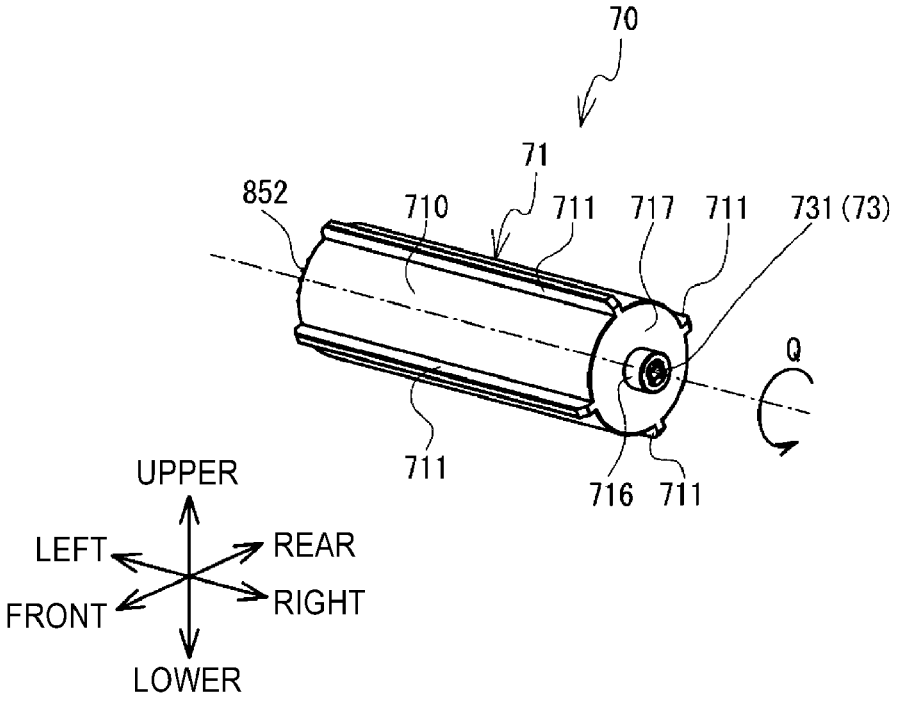
FIG. 19 is a perspective view of the roll holding member 70, as seen diagonally from the right front.
Figure 20:
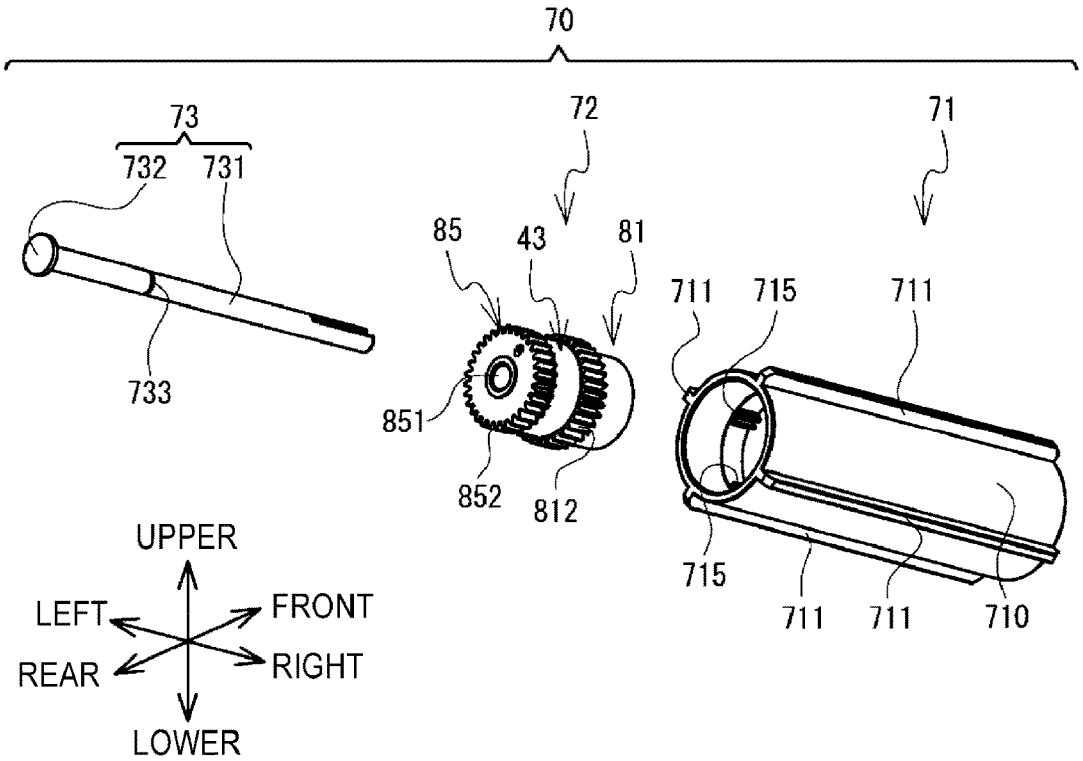
FIG. 20 is an exploded perspective view of the roll holding member 70, as seen diagonally from the left front.
Figure 21:
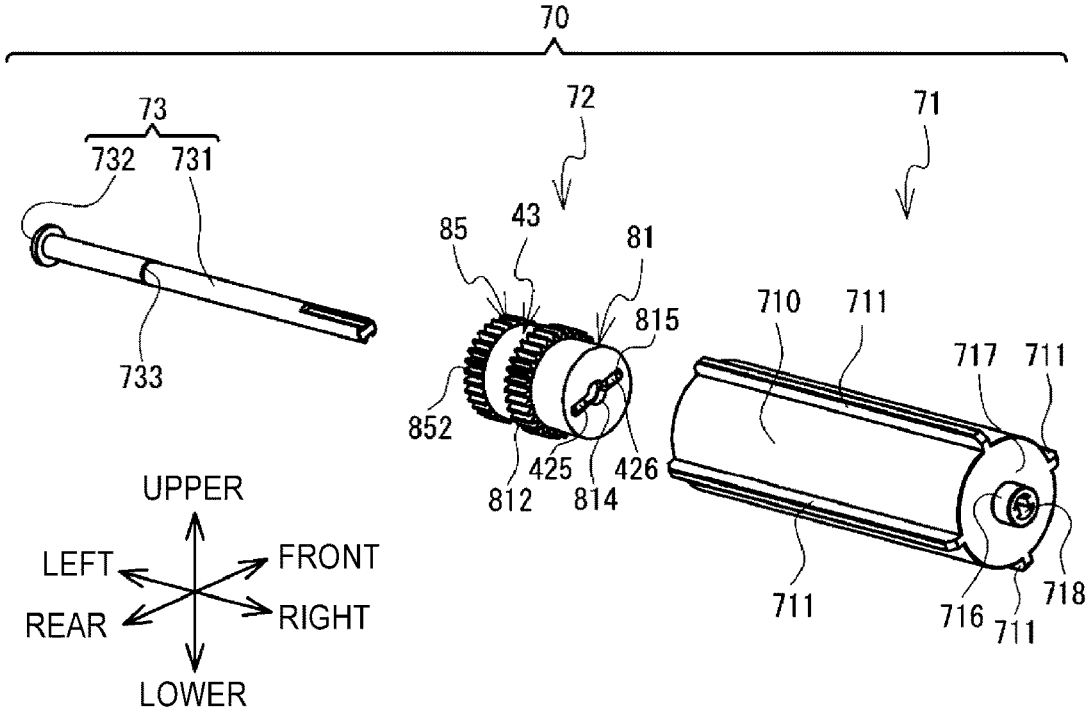
FIG. 21 is an exploded perspective view of the roll holding member 70, as seen diagonally from the right front.

A structure of the roll holding member 70 is described with reference to FIGS. 18 to 23. The roll holding member 70 shown in FIGS. 18 and 19 is configured by combining a plurality of components to be described later, and is a complex body having a substantially circular column shape extending in the right and left direction. As shown in FIGS. 20 and 21, the roll holding member 70 has a holding shaft 71, a rotation unit 72, and a support shaft 73 in corresponding order from the right. The rotation unit 72 is configured by combining five components to be described later.

As shown in FIGS. 20 and 21, the holding shaft 71 is formed of a resin material, and has a cylindrical part 710, four outer shape ribs 711, four locked tooth portions 715 (only two are shown in FIG. 20), a right support shaft 716 and the like. The cylindrical part 710 has a substantially bottomed cylindrical shape extending in the right and left direction and opening leftward. The four outer shape ribs 711 protrude radially outward from four positions equally spaced in a circumferential direction on an outer peripheral surface of the cylindrical part 710, and extend in parallel to a longitudinal direction of the cylindrical part 710. The four locked tooth portions 715 are provided in four positions equally spaced in a circumferential direction on an inner peripheral surface of the cylindrical part 710, and have a gear shape. The right support shaft 716 (refer to FIG. 21) protrudes rightward from a central portion of an outer surface of the bottom wall part 717 provided on a right side of the cylindrical part 710, and has a substantially short-axis cylindrical shape having a smaller diameter than the cylindrical part 710. The right support shaft 716 is formed with a central hole 718 extending in the right and left direction and communicating with an inner side of the cylindrical part 710.

Figure 22:
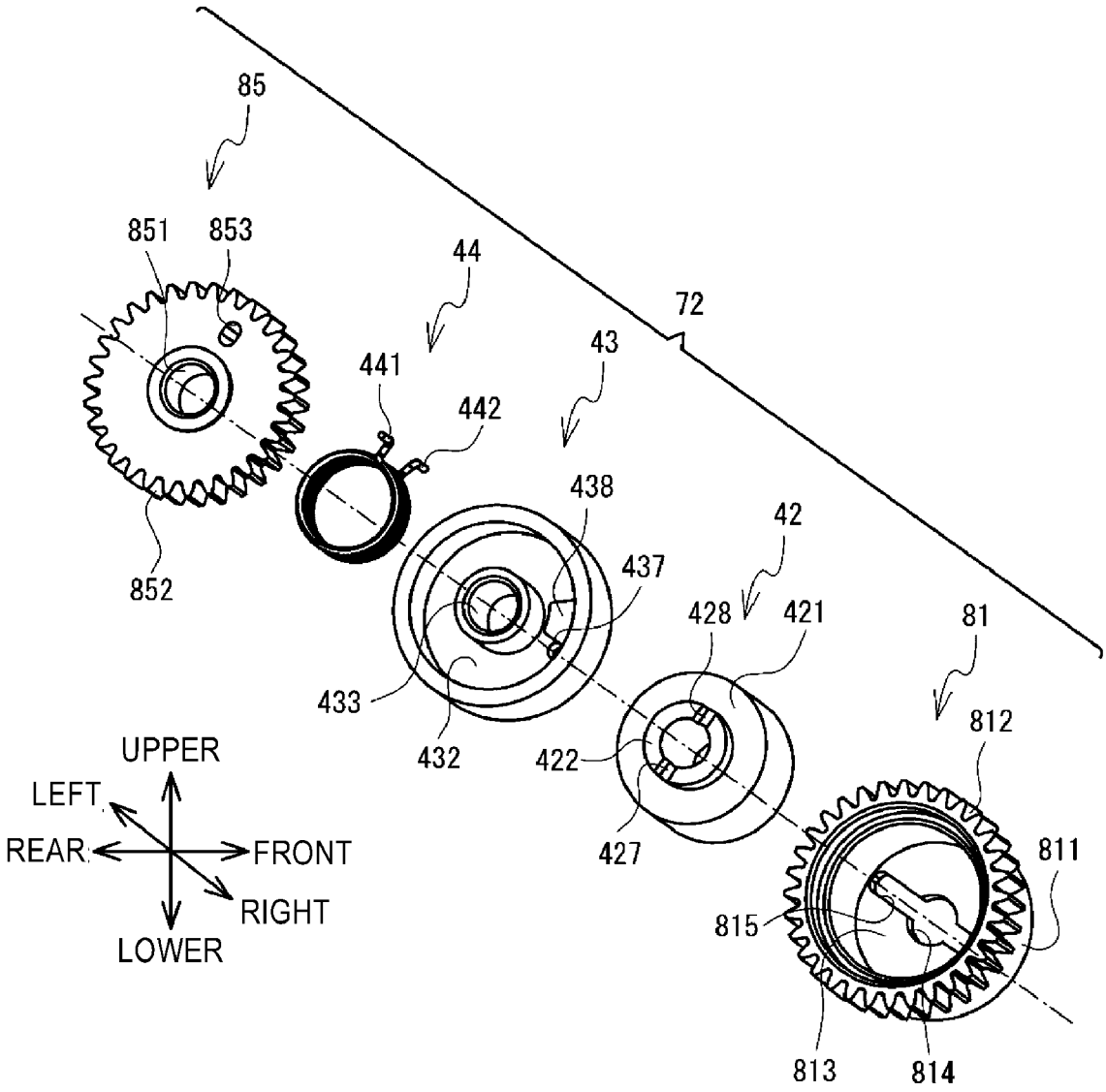
FIG. 22 is an exploded perspective view of a rotation unit 72, as seen diagonally from the left front.
Figure 23:
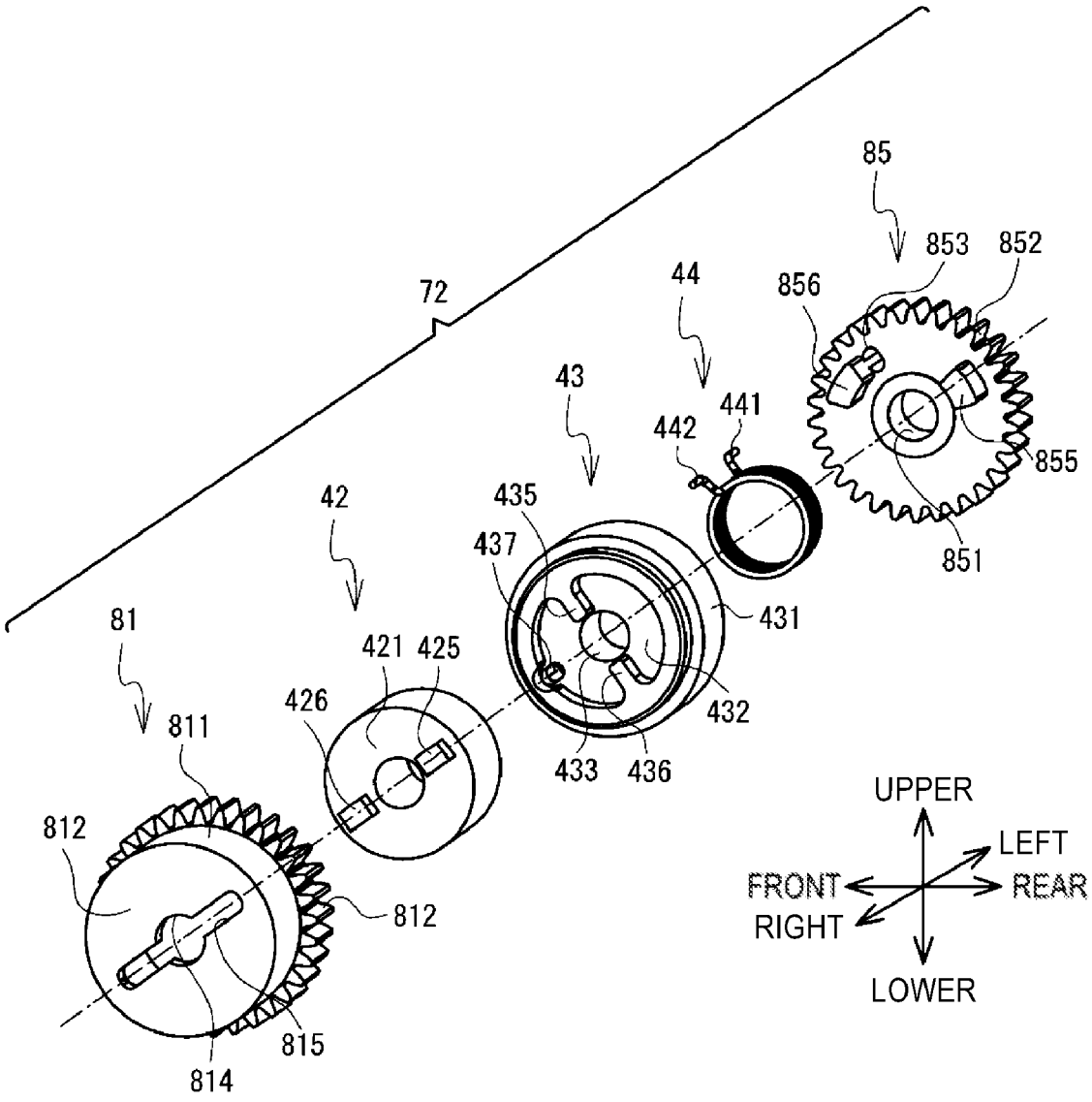
FIG. 23 is an exploded perspective view of the rotation unit 72, as seen diagonally from the right front.

A structure of the rotation unit 72 is described with reference to FIGS. 22 and 23. The rotation unit 72 has a fixed tube part 81, a torque limiter 42, an intermediate member 43, a torsion spring 44, a flange member 85 and the like in corresponding order from the right. In the meantime, since the torque limiter 42, the intermediate member 43 and the torsion spring 44 are the same components as the first embodiment, the descriptions thereof are omitted.

The fixed tube part 81 has a main body portion 811, a gear portion 812, a bottom wall portion 813, a shaft hole 814, a slit 815, etc. The main body portion 811 has a substantially bottomed cylindrical shape opening leftward. The main body portion 811 has a size capable of accommodating therein the torque limiter 42, the intermediate member 43 and the torsion spring 44. The gear portion 812 is provided in a circumferential direction on a left end-side of an outer peripheral surface of the main body portion 811 and has a gear shape having a plurality of teeth. The bottom wall portion 813 is provided at a right end portion of the main body portion 811, and has a substantially circular shape, as seen from a right side. The shaft hole 814 is formed at a central portion of the bottom wall portion 813. The slit 815 is a long hole extending from the shaft hole 814 toward both radial sides, and penetrates in the right and left direction.

The flange member 85 is formed into a disk shape, and has a shaft hole 851, a gear portion 852, a first protrusion 855, a second protrusion 856, and a spring locking hole 853. The shaft hole 851 is formed to penetrate a central portion of the flange member 85 in the right and left direction. The gear portion 852 is provided on an outer peripheral part of the flange member 85, and has a gear shape having a plurality of teeth. The first protrusion 855 and the second protrusion 856 (refer to FIG. 23) protrude rightward in positions spaced from each other in the circumferential direction on a right surface of the flange member 85. A spaced angle between the first protrusion 855 and the second protrusion 856 about the shaft hole 851 is about 120°. The spring locking hole 853 is formed to penetrate in the right and left direction in the vicinity of a rear side of the second protrusion 856.

As shown in FIGS. 20 and 21, the support shaft 73 is formed of a resin material, and has a circular column-shaped shaft portion 731 extending in the right and left direction and a flange-shaped head portion 732 formed at a left end. The shaft portion 731 is formed with a thin groove 733 for fitting a snap ring in a position at the slight left from a center in the right and left direction. A dimension in the right and left direction between the head portion 732 and the thin groove 733 is slightly greater than a dimension of the rotation unit 72 in the right and left direction. Also, an outer diameter of a right end portion of the shaft portion 731 is slightly greater than an inner diameter of the central hole 718.

An example of a method of assembling the rotation unit 72 is described with reference to FIGS. 22 and 23. The operator accommodates the torque limiter 42, the intermediate member 43, the torsion spring 44 and the flange member 85 inside of the main body portion 811 of the fixed tube part 81. First, the operator inserts the torque limiter 42 into the main body portion 811 of the fixed tube part 81. At this time, the operator engages the pair of convex portions 425 and 426 provided on the right end face of the main body ring portion 421 of the torque limiter 42 to the slit 815 of the bottom wall portion 813. Thereby, the main body ring portion 421 of the torque limiter 42 is integrated with the fixed tube part 81, and the circumferential rotation with respect to the main body portion 811 is limited.

Subsequently, the operator inserts sequentially the intermediate member 43 and the torsion spring 44 into the main body portion 811 having the torque limiter 42 inserted therein. In the meantime, since the method of assembling the intermediate member 43 and the torsion spring 44 into the main body portion 811 is the same as the first embodiment, the descriptions thereof are omitted.

Subsequently, the operator inserts the flange member 85 into the main body portion 811 having the torsion spring 44 inserted therein. The operator inserts the tip end portion of the arm portion 441 of the torsion spring 44 into the spring locking hole 853 of the flange member 85. In this way, the torque limiter 42, the intermediate member 43, the torsion spring 44 and the flange member 85 are accommodated inside of the main body portion 811 of the fixed tube part 81, so that the assembling of the rotation unit 72 is completed (refer to FIG. 20).

An example of a method of assembling the holding shaft 71, the rotation unit 72 and the support shaft 73 is described with reference to FIG. 20. The operator first assembles the rotation unit 72 and the support shaft 73 and then fits the holding shaft 71 into the rotation unit 72. Hereinbelow, it will be described in order. The operator inserts and penetrates the shaft portion 731 of the support shaft 73 from the shaft hole 851 of the flange member 85 of the rotation unit 72 toward the right. When the shaft portion 731 is inserted to a position in which the head portion 732 of the support shaft 73 comes into contact with the flange member 85, the thin groove 733 is exposed from the right side surface of the fixed tube part 81 of the rotation unit 72. Therefore, the operator fits a snap ring (not shown) in the thin groove 733. Thereby, the rotation unit 72 is supported to the support shaft 73 so as to be rotatable and to be immovable in the right and left direction (axial direction).

The operator inserts the rotation unit 72 into the cylindrical part 710 of the holding shaft 71 from the fixed tube part 81-side. Also, the operator pushes a right end portion of the shaft portion 731 of the support shaft 73 into the central hole 718 of the right support shaft 716. At this time, the gear portion 812 of the fixed tube part 81 is in mesh with the four locked tooth portions 715 provided on the inner side of the cylindrical part 710. Thereby, the fixed tube part 81 is integrated with the holding shaft 71, and the circumferential rotation with respect to the cylindrical part 710 of the holding shaft 71 is limited. Also, since the outer diameter of the shaft portion 731 is slightly greater than the inner diameter of the central hole 718, the shaft portion 731 pushed into the central hole 718 is lightly press-fitted. Therefore, the support shaft 73 is fixed so that it does not separate from the holding shaft 71.

The flange member 85 positioned on the left end-side of the rotation unit 72 protrudes from the left end-side of the cylindrical part 710 of the holding shaft 71 (refer to FIG. 18). In this way, the holding shaft 71, the rotation unit 72, and the support shaft 73 are combined with each other, so that the assembling of the roll holding member 70 is completed (refer to FIG. 18).

An example of a method of attaching the roll holding member 70 to the housing 60 is described. In the meantime, the roll holding member 70 is attached to the housing 60 with being internally fitted to the shaft center hole of the roll M2. At the left end portion of the roll holding member 70, the head portion 732 of the support shaft 73 and the gear portion 852 of the flange member 85 protrude leftward from the cylindrical part 710 of the holding shaft 71 (refer to FIG. 18). At the right end portion of the roll holding member 70, the right support shaft 716 protrudes rightward (refer to FIG. 19). The user inserts the head portion 732 of the support shaft 73 of the roll holding member 70 shown in FIG. 18 into the shaft supporting groove portion 661 of the left wall part 62 of the housing 60 shown in FIG. 17. The head portion 732 is supported to be rotatable in the shaft supporting groove portion 661. The gear portion 852 of the flange member 85 is engaged to the locked portion 651 of the left wall part 62 of the housing 60.

The user inserts the right support shaft 716 (refer to FIG. 19) of the roll holding member 70 into the shaft supporting groove 69 of the right wall part 63 of the housing 60, from above. The right support shaft 716 is supported to be rotatable in the shaft supporting groove 69. In this way, the attaching of the roll holding member 70 to the housing 60 is completed.

A rotating operation of the roll holding member 70 that is performed upon printing of the roll M2 is described. As shown in FIG. 16, the housing 60 is attached to the roll holding mechanism 15 of the printing apparatus 1. Since the method of attaching the housing 60 to the roll holding mechanism 15 is the same as the method of attaching the housing 30 of the first embodiment to the roll holding mechanism 15, the descriptions thereof are omitted. The user pulls out the linerless tape forward from the roll M2 held by the roll holding member 70, and causes the linerless tape to pass below the guide portion 671 of the left wall part 62 of the housing 60 and below the guide portion 681 of the right wall part 63 of the housing 60. Thereby, the housing 60 can prevent the linerless tape from floating.

In a state where the roll holding member 70 is attached to the housing 60, the right support shaft 716 of the holding shaft 71 is supported to be rotatable in the shaft supporting groove 69 of the right wall part 33 on the right end-side of the roll holding member 70. On the left end-side of the roll holding member 70, since the gear portion 852 of the flange member 85 is engaged to the locked portion 651 of the left wall part 62 of the housing 60, a position of the flange member 85 is fixed. The support shaft 73 is rotatably supported to the flange member 85 in the position-fixed state. Thereby, since the holding shaft 71 can rotate with respect to the housing 60, the roll M2 held by the holding shaft 71 can also rotate integrally.

When a printing operation of the printing apparatus 1 starts, the platen roller 13 is rotated by drive of the conveyor motor (not shown). The linerless tape is pulled out and conveyed forward from the roll M2 (refer to FIG. 16). As the linerless tape is pulled out forward, the holding shaft 71 starts to rotate in the clockwise direction, as seen from a left side (refer to a Q direction in FIGS. 18 and 19). In association with this, the torque limiter 42 and the intermediate member 43 of the rotation unit 72 shown in FIG. 22 are also rotated integrally with the holding shaft 71. The intermediate member 43 is rotated, so that the arm portion 442 of the torsion spring 44 locked to the intermediate member 43 is also rotated in the same direction but the flange member 45 to which the arm portion 441 is locked is not rotated. Thereby, the torsion spring 44 is bent in a winding direction, so that the force weaker than the set torque of the torque limiter 42 is biased to the intermediate member 43 in an opposite direction to the rotating direction of the holding shaft 71.

Upon start of the printing operation, the engaging protrusion 438 (refer to FIG. 22) of the intermediate member 43 is located in a position in which it is in contact with the second protrusion 856 (refer to FIG. 23) of the flange member 85. When the intermediate member 43 is rotated together with the holding shaft 71 with respect to the flange member 85 in the clockwise direction, as seen from a left side, the engaging protrusion 438 is rotated in the same direction about the support shaft 73. Thereby, the engaging protrusion 438 is rotated until it comes into contact with the first protrusion 855 of the flange member 85. The torsion spring 44 is bent in a winding direction, so that it biases the intermediate member 43 in the opposite direction to the rotating direction of the holding shaft 71.

When the engaging protrusion 438 comes into contact with the first protrusion 855, the intermediate member 43 and the flange member 85 are integrated. Herein, since the holding shaft 41 continues to rotate but the intermediate member 43 does not rotate, torque exceeding the set torque is applied to the torque limiter 42. At this time, the main body ring portion 421 engaged to the holding shaft 41 is slid with respect to the driven ring portion 422 of the torque limiter 42 engaged to the intermediate member 43. Thereby, while the linerless tape is pulled out forward from the roll M2, the roll holding member 70 can apply predetermined tension to the linerless tape by the set torque of the torque limiter 42, like the first embodiment.

After executing the printing operation, the printing apparatus 1 reverses the linerless tape before a next printing operation, so as to reduce a leading margin corresponding to a distance between the thermal head 14 and the cutting part. At this time, since the tension applied by the torque limiter 42 is released, the engaging protrusion 438 of the intermediate member 43 is rotated from a position in which it is in contact with the first protrusion 855 of the flange member 85 to a position in which it comes into contact with the second protrusion 856 by the biasing force of the torsion spring 44. In this way, the holding shaft 71 is reversed, so that the linerless tape can be wound. Thereby, since the loosening is not caused in the linerless tape, the printing apparatus 1 of the second embodiment can also execute favorably a next printing operation, like the first embodiment.

In the above descriptions, the locked portion 651 provided to the left wall part 62 of the housing 60 is an example of "the locked portion" of the present disclosure. In the roll holding member 70, the support shaft 73 and the right support shaft 716 are examples of "the support shaft" of the present disclosure. The flange member 85 is an example of "the rotation locking member" of the present disclosure, and the gear portion 852 is an example of "the locking portion" of the present disclosure.

As described above, the attachment 200 of the second embodiment can also achieve the similar effects to the first embodiment.

The attachment and the printing apparatus of the present disclosure are not limited to the above embodiments, and can be diversely changed without departing from the spirit of the present disclosure.

In the first embodiment, the attachment 100 includes the housing 30 having a substantially box shape of which the upper part is opened. However, instead of the housing 30, for example, the bottom wall part 31 of the housing 30 may be omitted, and a pair of sidewall members corresponding to the left wall part 32 and the right wall part 33 may configure the housing. In the meantime, this also applies to the housing 60 of the second embodiment.

In the first embodiment, although the bottom wall part 31 of the housing 30 has such a shape that the central portion is curved downwardly in a substantial arc shape, as seen from a side, the bottom wall part 31 of the housing 30 may have a planar shape. Preferably, when the bottom wall part 31 is curved in conformity to the shape of the main body cover 10, the bottom wall part 31 can be brought closer to the upper surface of the main body cover 10, so that it is possible to secure a wider space inside of the housing 30. In the meantime, this also applies to the housing 60 of the second embodiment.

In the first embodiment, the left wall part 32 of the housing 30 is provided with the first protrusion portion 321 and the second protrusion portion 322 but may be provided with any one or two or more, for example. When two or more protrusion portions are provided, it is possible to prevent the left wall part 32 from rotating and being positionally misaligned with respect to the facing surface 17 of the left holding part 7 of the roll holding mechanism 15. In the meantime, this also applies to the right wall part 33 of the housing 30 and to the housing 60 of the second embodiment.

In the first embodiment, the shape of each of the first protrusion portion 321, the second protrusion portion 322 and the third protrusion portion 323 is not limited to the embodiment and can be freely changed, and may have a substantially circular column shape, like the first protrusion portion 631 and the second protrusion portion 632 of the second embodiment, for example. In the first embodiment, the pin 321A of the first protrusion portion 321 is engaged to the first circular engaged hole 174 of the left holding part 7 of the roll holding mechanism 15. However, for example, the first engaged hole 174 may be made to have a rectangular shape and engaged to the first protrusion portion 321. In the meantime, this also applies to the right wall part 33 of the housing 30 and to the housing 60 of the second embodiment.

In the first embodiment, the roll holding member 40 has the holding shaft 41, the torque limiter 42, the intermediate member 43, the torsion spring 44 and the flange member 45 combined with each other in corresponding order from the right. However, for example, the corresponding structure may be changed into a bilaterally symmetrical structure, so that the holding shaft 41, the torque limiter 42, the intermediate member 43, the torsion spring 44 and the flange member 45 are combined with each other in corresponding order from the left. In this case, since the rectangular portion 452 of the flange member 45 is arranged at the right, the right wall part 33 of the housing 30 may be provided with the locked groove and the right wall part 33 may be provided with the shaft supporting groove. In the meantime, this also applies to the roll holding member 70 of the second embodiment.

In the attachment 100 of the first embodiment, the rectangular portion 452 of the flange member 45 is fitted to the locked groove 35 of the left wall part 32 of the housing 30. However, the structure for limiting the circumferential rotation about the left support shaft 54 of the flange member 45 may be another structure, for example, the structure of the second embodiment.

The roll holding member 40; 70 has the torque limiter 42, as "the resistance applying part" of the present disclosure. However, another member is also possible, and for example, a clutch spring may also be used.

What is claimed is:

1. A printing apparatus comprising:

a printing device;

a first holding part and a second holding part configured to slide and to hold a print roll between each other and located adjacent the printing device, wherein the first holding part includes:

a first print roll holding part configured to hold the print roll; and a first print roll holder holding part configured to hold a print roll holder, and wherein the second holding part includes:

a second print roll holding part configured to hold the print roll;

a second print roll holder holding part configured to hold the print roll holder, and wherein the print roll holder is configured to be capable of holding the print roll, the print roll holder including:

a first wall including a first positioning part configured to position the first wall at the first holding part of the printing apparatus;

a second wall facing to the first wall, the second wall including a second positioning part configured to position the second wall at the second holding part of the printing apparatus; and a connection part connecting the first wall and the second wall.

2. The printing apparatus according to claim 1, wherein the first print roll holding part includes a first protrusion extending toward the second print roll holding part, and wherein the second print roll holding part includes a second protrusion extending toward the first print roll holding part.

* * * * *